US008850972B2

(12) United States Patent
Caveney et al.

(10) Patent No.: US 8,850,972 B2
(45) Date of Patent: Oct. 7, 2014

(54) METAL EMBOSSING HAND TOOL

(75) Inventors: Jack Edward Caveney, North Palm Beach, FL (US); Mateusz Kruzel, Orland Park, IL (US); Mark Shurhay, Westchester, IL (US); James R. Ward, Naperville, IL (US)

(73) Assignee: Panduit Corp., Tinley Park, IL (US)

( * ) Notice: Subject to any disclaimer, the term of this patent is extended or adjusted under 35 U.S.C. 154(b) by 830 days.

(21) Appl. No.: 13/073,209

(22) Filed: Mar. 28, 2011

(65) Prior Publication Data

US 2011/0252855 A1 Oct. 20, 2011

Related U.S. Application Data

(60) Provisional application No. 61/324,180, filed on Apr. 14, 2010.

(51) Int. Cl.

| | |
|---|---|
| ***B41F 19/02*** | (2006.01) |
| ***B26D 11/00*** | (2006.01) |
| ***B44B 5/02*** | (2006.01) |
| ***B26D 9/00*** | (2006.01) |
| *B26D 5/10* | (2006.01) |
| *B26D 7/27* | (2006.01) |
| *B26D 5/16* | (2006.01) |

(52) U.S. Cl.

CPC . *B26D 9/00* (2013.01); *B44B 5/026* (2013.01); *B26D 5/10* (2013.01); *B26D 7/27* (2013.01); *B26D 5/16* (2013.01)

USPC ..... 101/19; 101/30; 83/862

(58) Field of Classification Search

USPC ..... 101/3.1, 18, 19, 26, 28–30; 83/862, 879

See application file for complete search history.

(56) References Cited

U.S. PATENT DOCUMENTS

| | | | | |
|---|---|---|---|---|
| 2,275,670 | A | 3/1942 | Zipf | |
| 3,237,494 | A | 3/1966 | Norvelle | |
| 3,272,301 | A * | 9/1966 | Craig | 400/134.5 |
| 5,805,193 | A | 9/1998 | Follett et al. | |

FOREIGN PATENT DOCUMENTS

| | | |
|---|---|---|
| EP | 1583083 A2 | 6/2005 |
| GB | 2327411 A | 1/1999 |

* cited by examiner

*Primary Examiner* — Ren Yan

(74) *Attorney, Agent, or Firm* — Christopher S. Clancy; Almee E. McVady

(57) ABSTRACT

The preset invention is directed to an embossing tool. The embossing tool includes a drive mechanism that advances a tape, an embossing mechanism and a cutting mechanism. The cutting mechanism cuts the tape to form a tag. The cutting mechanism also forms a mounting feature in the ends of the tag. The cutting mechanism includes a pair of dies with openings therethrough and at least one punch moveable within the openings for engaging the tape.

12 Claims, 27 Drawing Sheets

METAL EMBOSSING HAND TOOL

CROSS-REFERENCE TO RELATED APPLICATION

This application claims priority to U.S. Provisional Application No. 61/324,180, filed Apr. 14, 2010, the subject matter of which is hereby incorporated by reference in its entirety.

FIELD OF THE INVENTION

The present invention relates to a metal embossing hand tool, and more particularly to a metal embossing hand tool with a multifunction cutting die.

BACKGROUND OF THE INVENTION

Hand tools are used to emboss metal tape to create identification tags or plates. Once the metal tape has been embossed with the desired text, the tool typically cuts the tape to create a tag or plate. Prior tools have provided a device for cutting or punching a slot or hole at each end of the embossed tag or plate.

Typically, after the tape has been embossed and cut, the newly formed tag or plate is reinserted into the front of the tool. The front of the tool includes a number of punch openings for receiving the tag or plate to create a hole or slot. The hole or slot enables the tag or plate to be attached via screws, nails, other similar fasteners, or cable ties. One end of the tag or plate would be inserted into one of the openings and a handle would be actuated thereby punching the desired hole or slot. Next, the opposite end of the tag or plate would be inserted into the opening and the handle would be actuated to punch an identical hole or slot at the opposite end.

Thus, there is a need for an improved and more efficient metal embossing hand tool that simultaneously cuts the embossed tape to form a tag or plate and punches a slot to receive a cable tie or wire.

SUMMARY OF THE INVENTION

The present invention is directed to a metal embossing hand tool. The metal embossing hand tool includes a drive mechanism for advancing a metal tape, an embossing mechanism and a cutting mechanism. The cutting mechanism simultaneously cuts the metal tape to form a metal tag and to form a mounting feature at each end of the metal tag. The cutting mechanism includes a pair of dies with openings therethrough and at least one punch that moves within the openings to engage the tape. The at least one punch includes a cut off punch that forms semi-circular ends and a mounting feature punch that forms a mounting feature on a trailing end of a first formed tag and a mounting feature on a leading end of a second formed tag.

DETAILED DESCRIPTION

Figure 1:
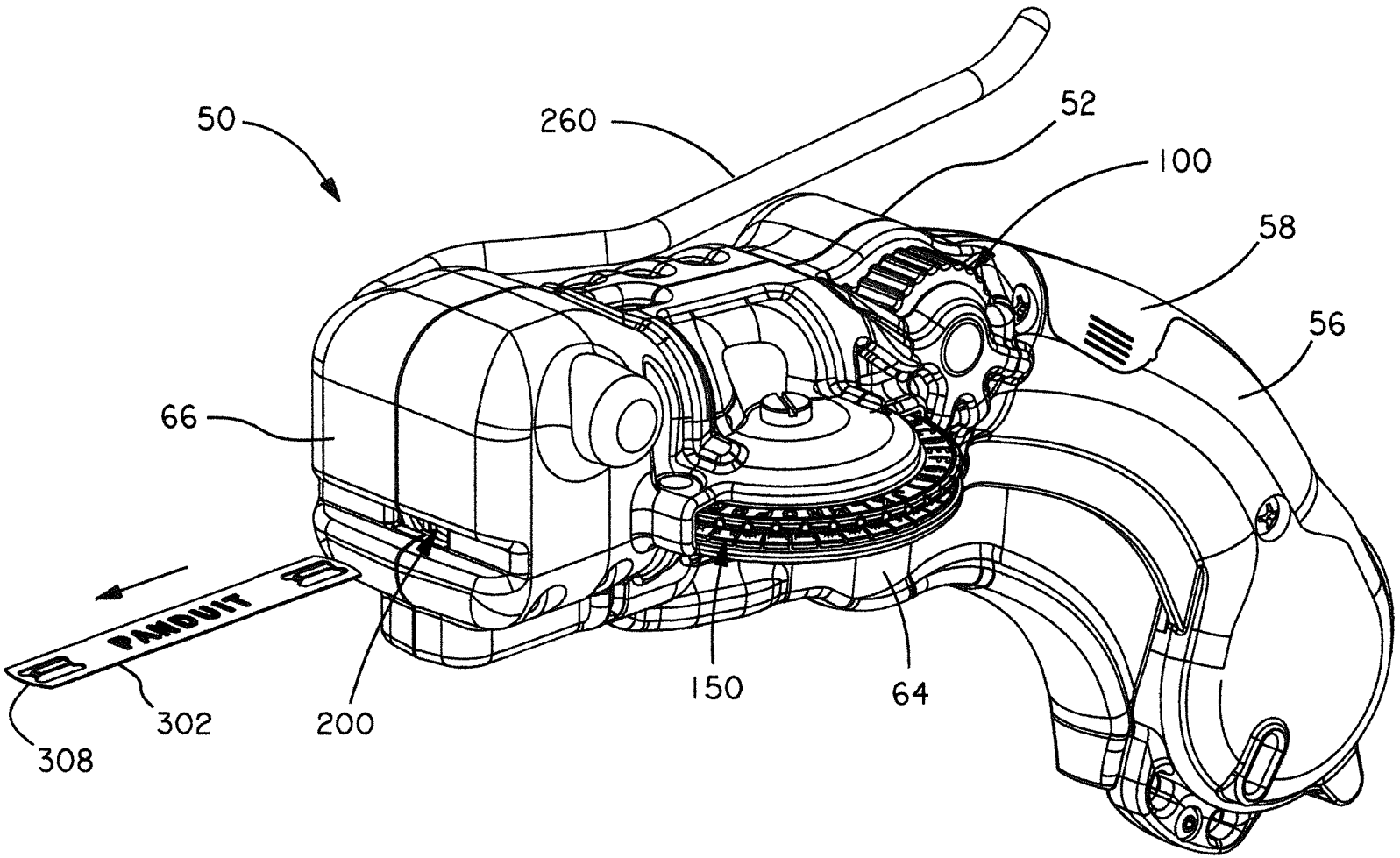
FIG. 1 is a front left side perspective view of the metal embossing hand tool of the present invention.
Figure 2:
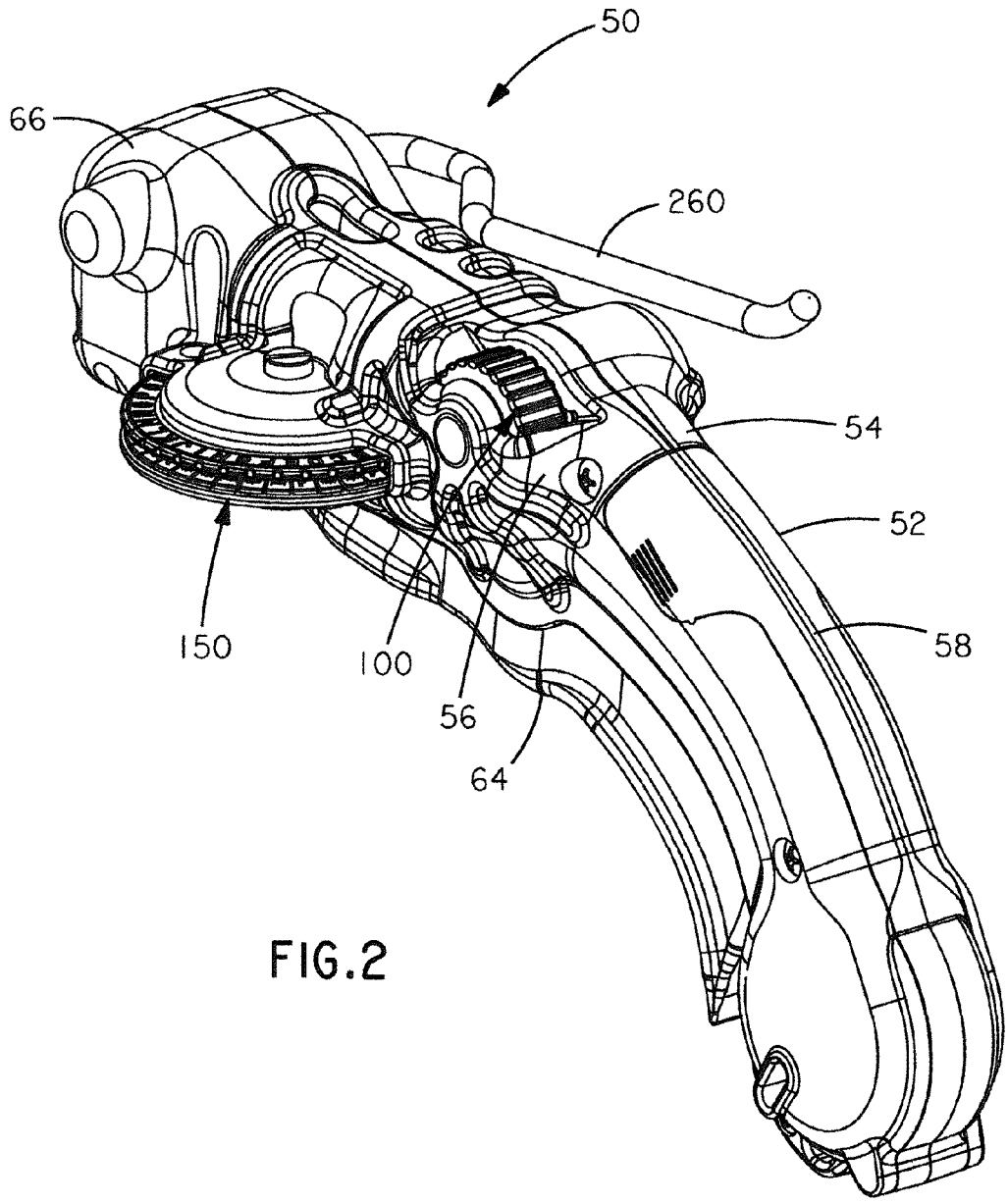
FIG. 2 is a back left side perspective view of the metal embossing hand tool of FIG. 1.
Figure 3:
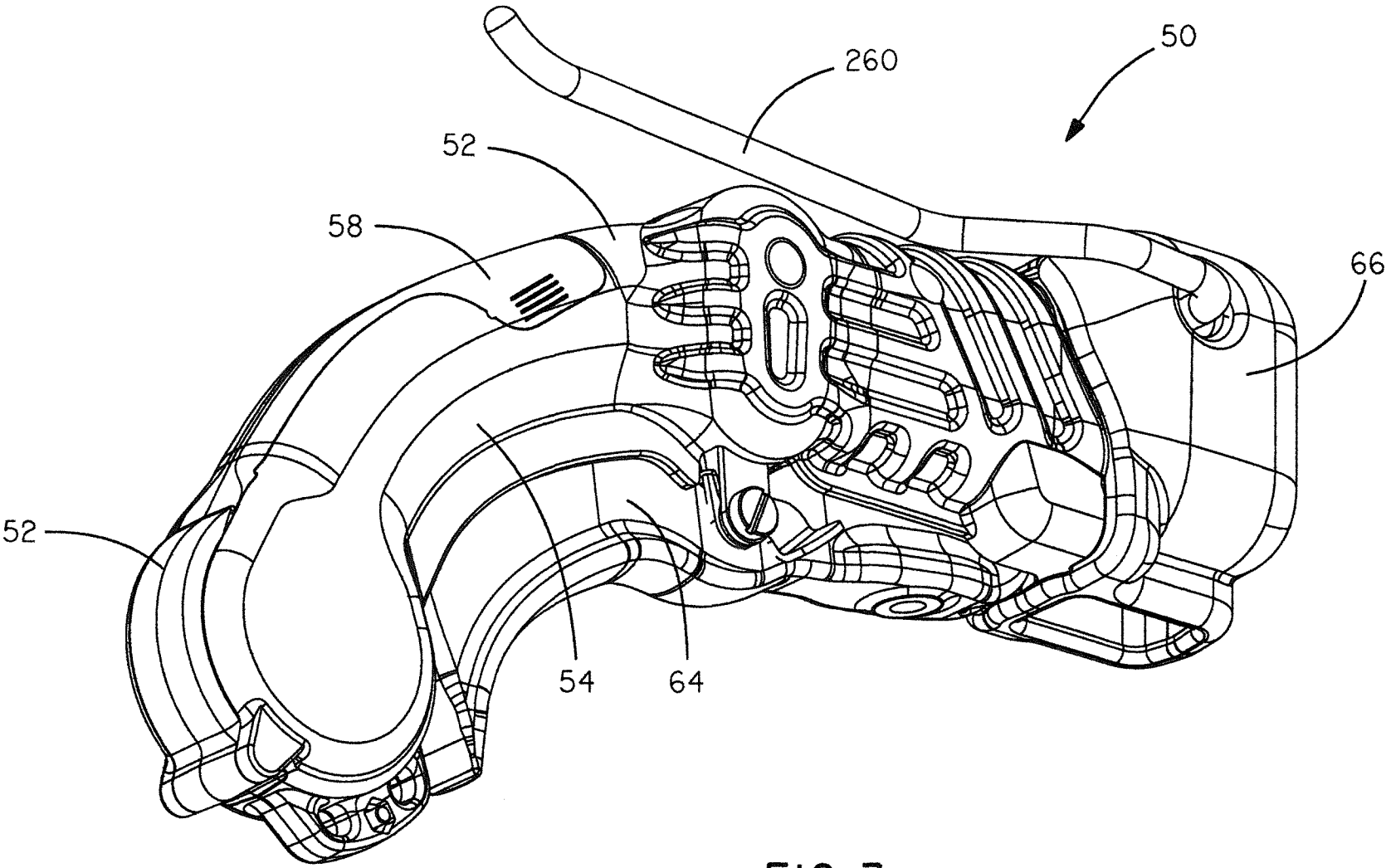
FIG. 3 is a back right side perspective view of the metal embossing hand tool of FIG. 1.

FIGS. 1-3 illustrate perspective views of the metal embossing hand tool 50 of the present invention. The metal embossing hand tool 50 is used to emboss characters on a stainless steel or aluminum tape 300. Once the tape 300 has been embossed, the metal embossing hand tool 50 creates a universal mounting feature and cuts the tape off the roll with a semi-circular end 308 thereby eliminating any sharp edges.

The metal embossing hand tool 50 includes a main body 52 with a right body enclosure 54 and a left body enclosure 56. A flip up cover 58 is pivotally attached to the right and left body enclosures 54, 56 such that the flip up cover 58 is positioned adjacent to the right and left body enclosures 54, 56 when the flip up cover 58 is in a closed position. A hand lever 64 is pivotally attached at the bottom of the main body 52 adjacent to the right and left body enclosures 54, 56. The front of the metal embossing hand tool 50 includes a protective sleeve 66.

Figure 4:
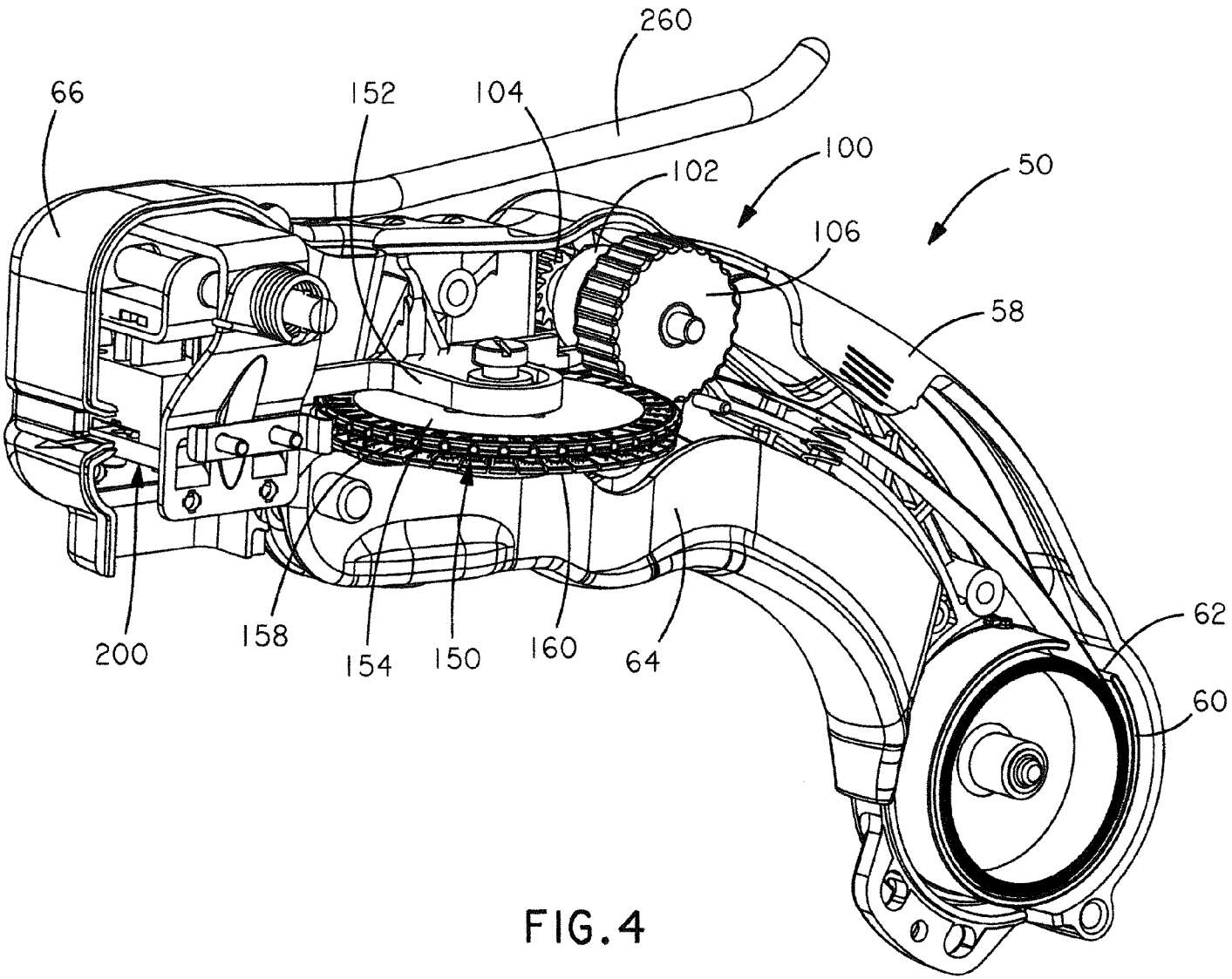
FIG. 4 is a front left side perspective view of the metal embossing hand tool of FIG. 1 with the left body enclosure removed.
Figure 5:
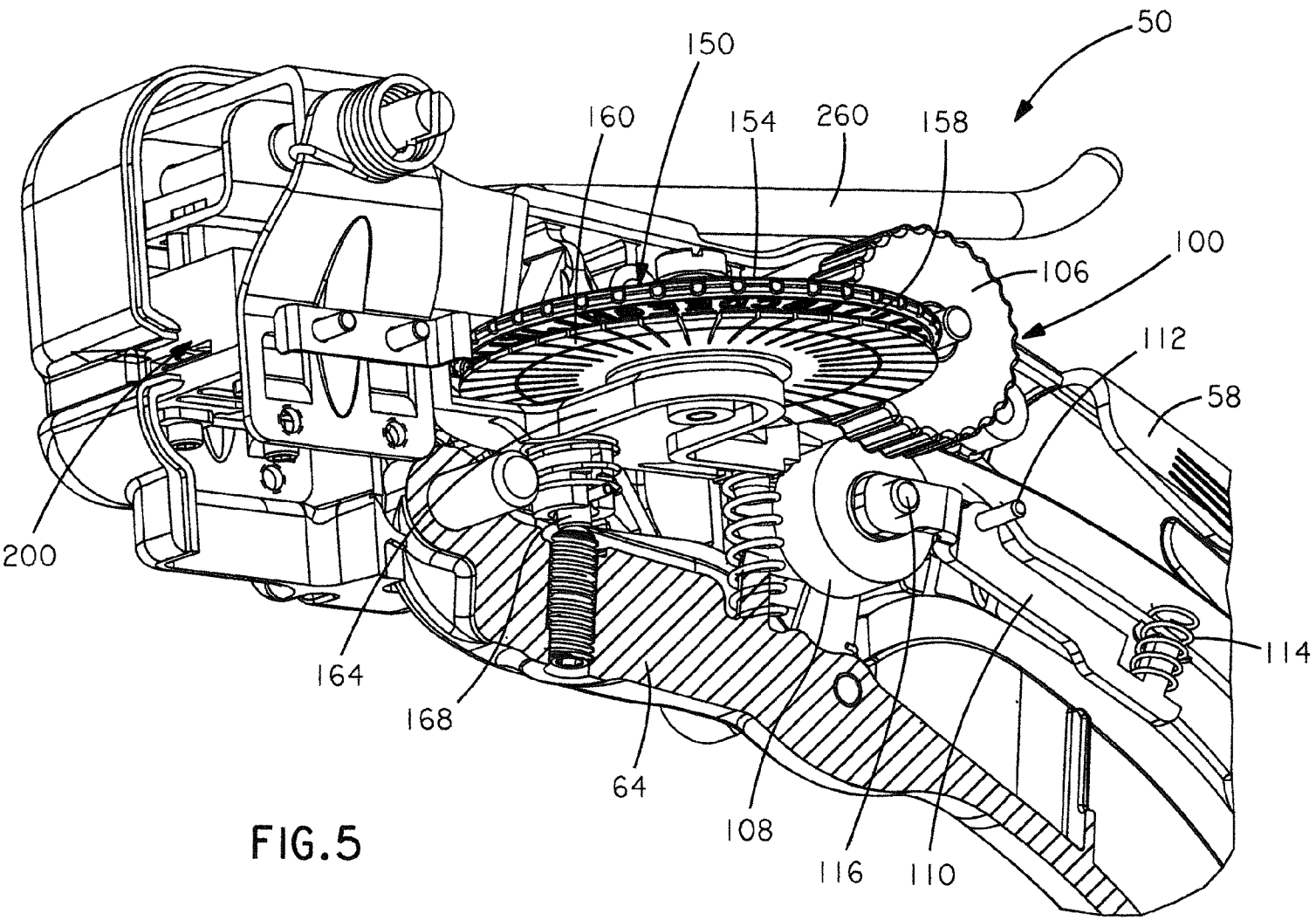
FIG. 5 is a bottom left side perspective view of the metal embossing hand tool of FIG. 4.
Figure 6:
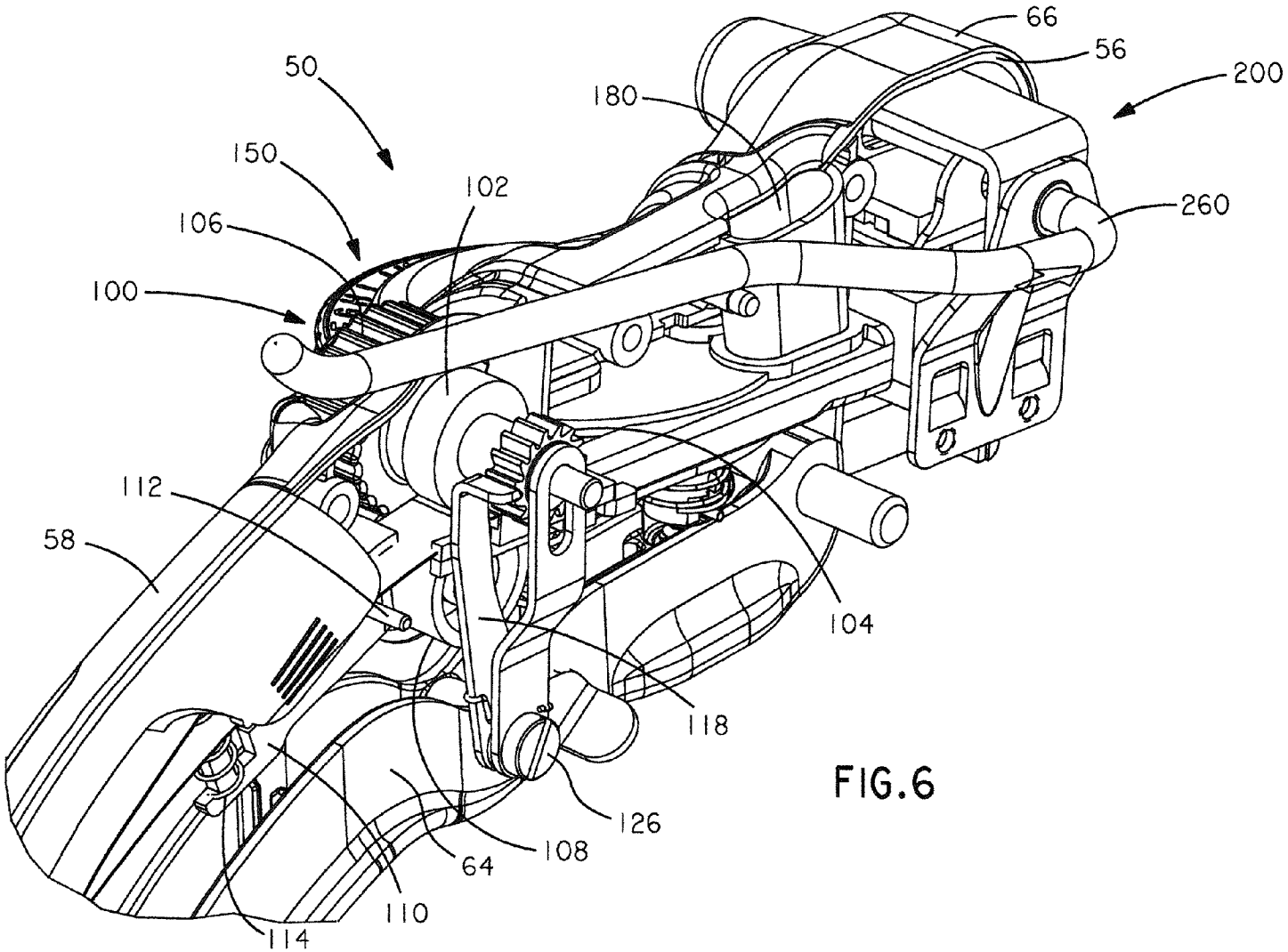
FIG. 6 is a back right side perspective view of the metal embossing hand tool of FIG. 1 with the right body enclosure removed.
Figure 7:
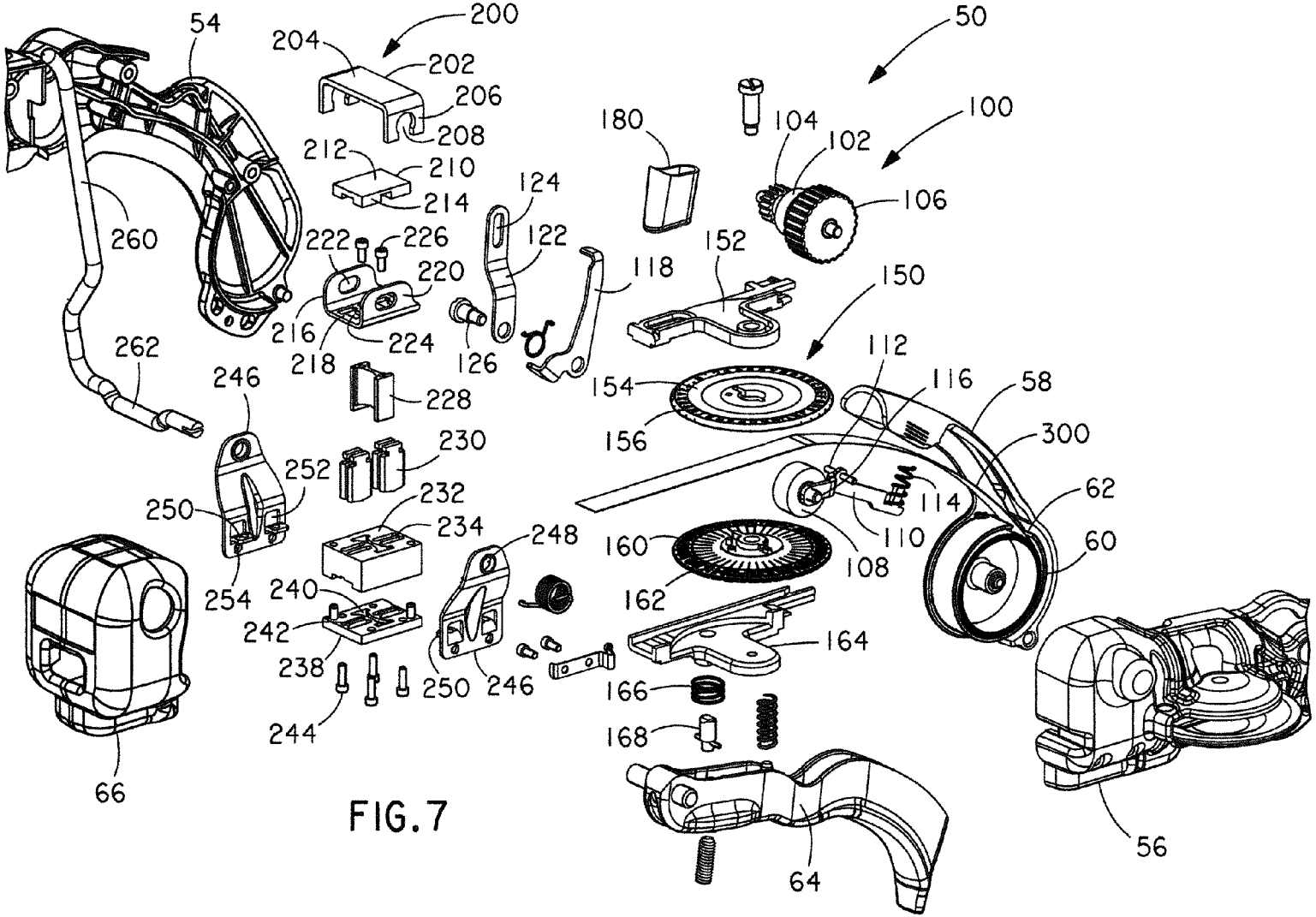
FIG. 7 is a partially exploded view of the metal embossing hand tool of FIG. 1.
Figure 8:
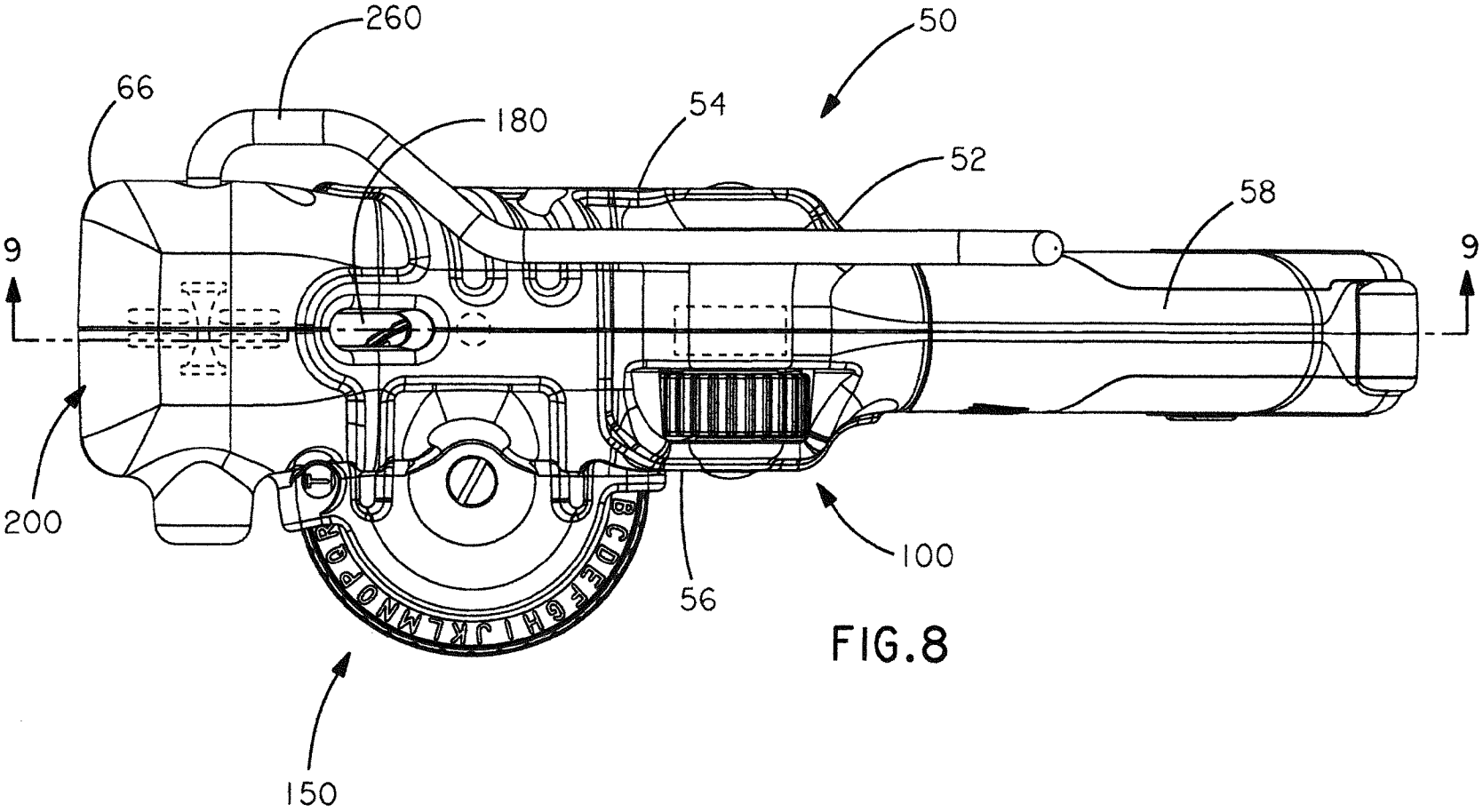
FIG. 8 is a top view of the metal embossing hand tool of FIG. 1.

FIG. 4 illustrates the left side of the metal embossing hand tool 50 with the left body enclosure 56 removed. The metal embossing hand tool 50 includes a drive mechanism 100, an embossing mechanism 150 and a multifunction cutting die 200. FIG. 5 illustrates the left side of the metal embossing hand tool 50 with the left body enclosure 56 and the hand lever 64 removed. FIG. 6 illustrates the right side of the metal embossing hand tool 50 with the right body enclosure 54 removed. FIG. 7 illustrates a partially exploded view of the drive mechanism 100, the embossing mechanism 150 and the multifunction cutting die 200 of the metal embossing hand tool 50.

The drive mechanism 100 is designed to pull a stainless steel or aluminum tape 300 from a tape holder 60 and feed the tape 300 through the metal embossing hand tool 50. As illustrated in FIG. 4, the tape 300 is supplied as a continuous roll that is stored in the tape holder 60 located in the flip up cover 58. The tape 300 extends out of an opening 62 in the tape holder 60 towards the drive mechanism 100.

Figure 9:
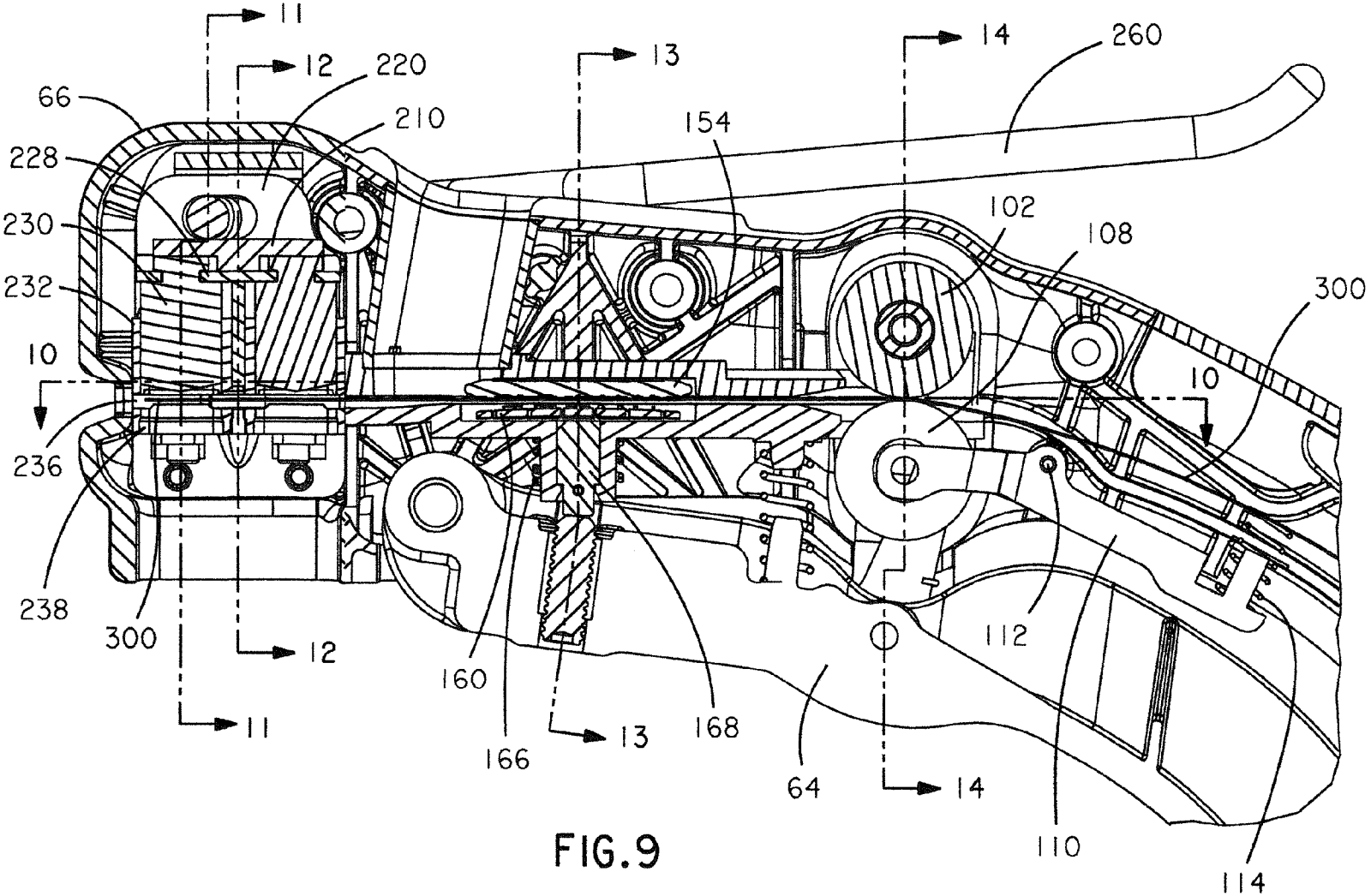
FIG. 9 is a cross-sectional view of the metal embossing hand tool of FIG. 8 taken along line 9-9.

When the hand lever 64 or the manual advance wheel 106 (see FIGS. 26-27) is activated, the metal tape 300 is pulled between the drive wheel 102 and an idler wheel 108 (see FIG. 9). As illustrated in FIG. 5, the idler wheel 108 is mounted to a pivot 110 and is allowed to spin freely on a shoulder bolt 116. One end of the pivot arm 110 is connected to the main body 52 by a pivot pin 112. The other end of the pivot arm 110 is connected to a compression spring 114. The compression spring 114 creates the force that pushes the idler wheel 108 into the drive wheel 102.

The drive wheel 102 is made of a hard rubber to allow it to grip the metal tape 300 and feed it into the embossing mechanism 150. As the rubber drive wheel 102 wears from use, the pivot arm 110 automatically adjust to keep the idler wheel 108 and the drive wheel 102 in contact to properly feed the tape 300. Thus, the drive mechanism 100 eliminates tolerance stack-up issues because the idler wheel 108 automatically adjusts relative to the drive wheel 102.

As illustrated in FIG. 6, the drive wheel 102 and the idler wheel 108 are rotated by a ratchet wheel 104. An indexing arm 118 is connected to the hand lever 64. As the hand lever 64 is actuated, the indexing arm 118 advances the ratchet wheel 104 one tooth at a time. Each time the hand lever 64 is actuated the tape 300 is advanced through the tool 50. If the hand lever 64 is actuated a half stroke, only the tape 300 is fed. If the hand lever 64 is actuated a full stroke, the tape 300 is fed and the embossing pin 168 is activated (see FIG. 5).

After the tape 300 is advanced through the drive mechanism 100, the metal tape 300 is feed through the embossing mechanism 150.

As illustrated in FIGS. 4, 5 and 7, the embossing mechanism 150 includes a top wheel holder 152 and a top wheel 154 with recessed characters 156. The embossing mechanism 150 also includes a bottom wheel holder 164 and a bottom wheel 160 with raised characters 162. The top wheel 154 and the bottom wheel 160 are positioned so that there is an opening 158 therebetween to receive the metal tape 300. An embossing pin 168 is positioned below the bottom wheel 160. The embossing pin 168 is actuated by the hand lever 64. As discussed below with respect to FIG. 13, the embossing pin 168 initiates the flex on an individual raised character 162 on the bottom embossing wheel 160 when the hand lever 64 is engaged. The raised character 162 pushes the metal tape 300 into the recessed character 156 on the top embossing wheel 154 thereby embossing the character onto the metal tape 300.

After the tape 300 is embossed, the drive wheel 102 advances the metal tape 300 into the multifunction cutting die 200. The operator actuates the hand lever 64 to properly position the tape 300 for cut off. The multifunction cutting die 200 cuts the tape 300 off the continuous roll with a semi-circular end to eliminate any sharp edges. The multifunction cutting die 200 also forms a universal mounting feature on the trailing end 304 of tag 302 or plate and the leading end 306 of tape 300. As discussed below, the universal mounting feature includes two holes or slots 312 large enough for either a cable tie or a wire (see FIG. 17A). The universal mounting feature also includes a raised section 310 in the middle for allowing a cable tie to thread easily through the hole or slot 312 to secure the tag 302 or plate flush with a surface.

As illustrated in FIG. 7, the multifunction cutting die 200 includes an upper die plate 232 and a lower die plate 238 with a plurality of openings 234, 240, respectively, for receiving a cut off punch 228 and mounting feature punches 230. The lower die plate 238 also includes a raised portion 242 for forming the raised section 310 in the tag 302 or plate (see FIG. 19). The multifunction cutting die 200 also includes an upper holder member 202, a lower holder member 210 and a punch retainer plate 216. A handle bracket 246 with an opening 248 at the top center of the bracket 246 is positioned on the right side and the left side of the upper and lower die plates 232, 238, respectively. As discussed below, a wire handle 260 extends through the handle brackets 246 and the punch retainer plate 216.

FIGS. 8-14 illustrate the metal embossing hand tool 50 with the metal tape 300 extending through the drive mechanism 100, embossing mechanism 150 and the multifunction cutting die 200 before the cutting die 200 is activated. More specifically, as illustrated in FIG. 9, the tape 300 is positioned between the drive wheel 102 and the idler wheel 108, the top embossing wheel 154 and the bottom embossing wheel 160 and the upper die plate 232 and the lower die plate 238.

Figure 10:
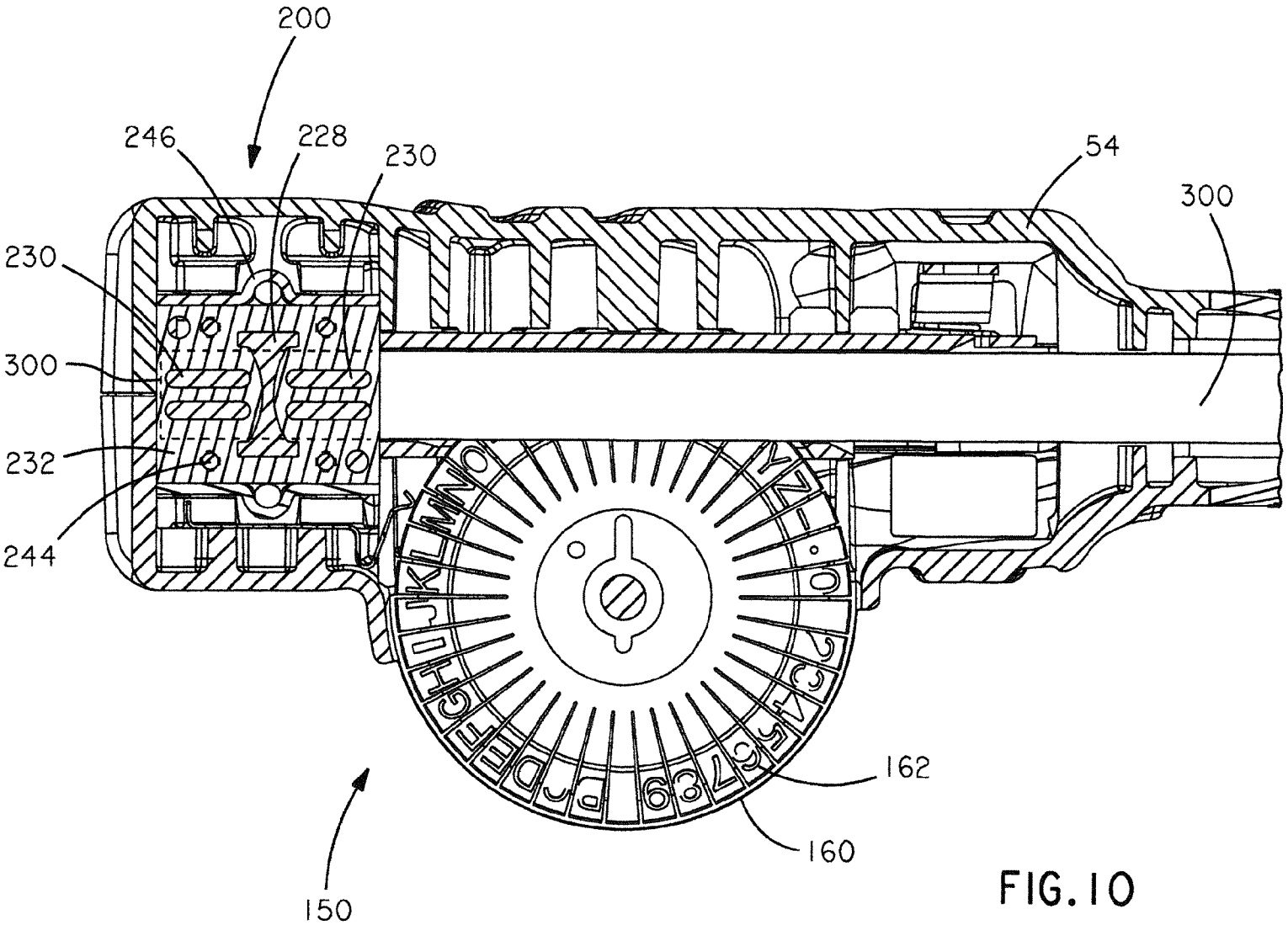
FIG. 10 is a cross-sectional view of the metal embossing hand tool of FIG. 9 taken along line 10-10.

FIG. 10 illustrates a cross-sectional view of the multifunction cutting die 200 with the tape 300 positioned in the cutting die 200. As discussed above, the tape 300 is positioned in the opening 236 between the upper die plate 232 and the lower die plate 238. The mounting feature punches 230 and the cut off punch 228 are positioned in the upper die plate 232 above the tape 300. FIG. 10 illustrates an outline of the mounting feature punches 230 and the cut off punch 228 with respect to the tape 300. As discussed below with respect to FIGS. 15-25, once the wire handle 260 activates the multifunction cutting die 200, the mounting feature punches 230 and the cut off punch 228 are pushed downwards through the tape 300 and into the lower die plate 238 to form a tag 302 or plate.

Figure 11:
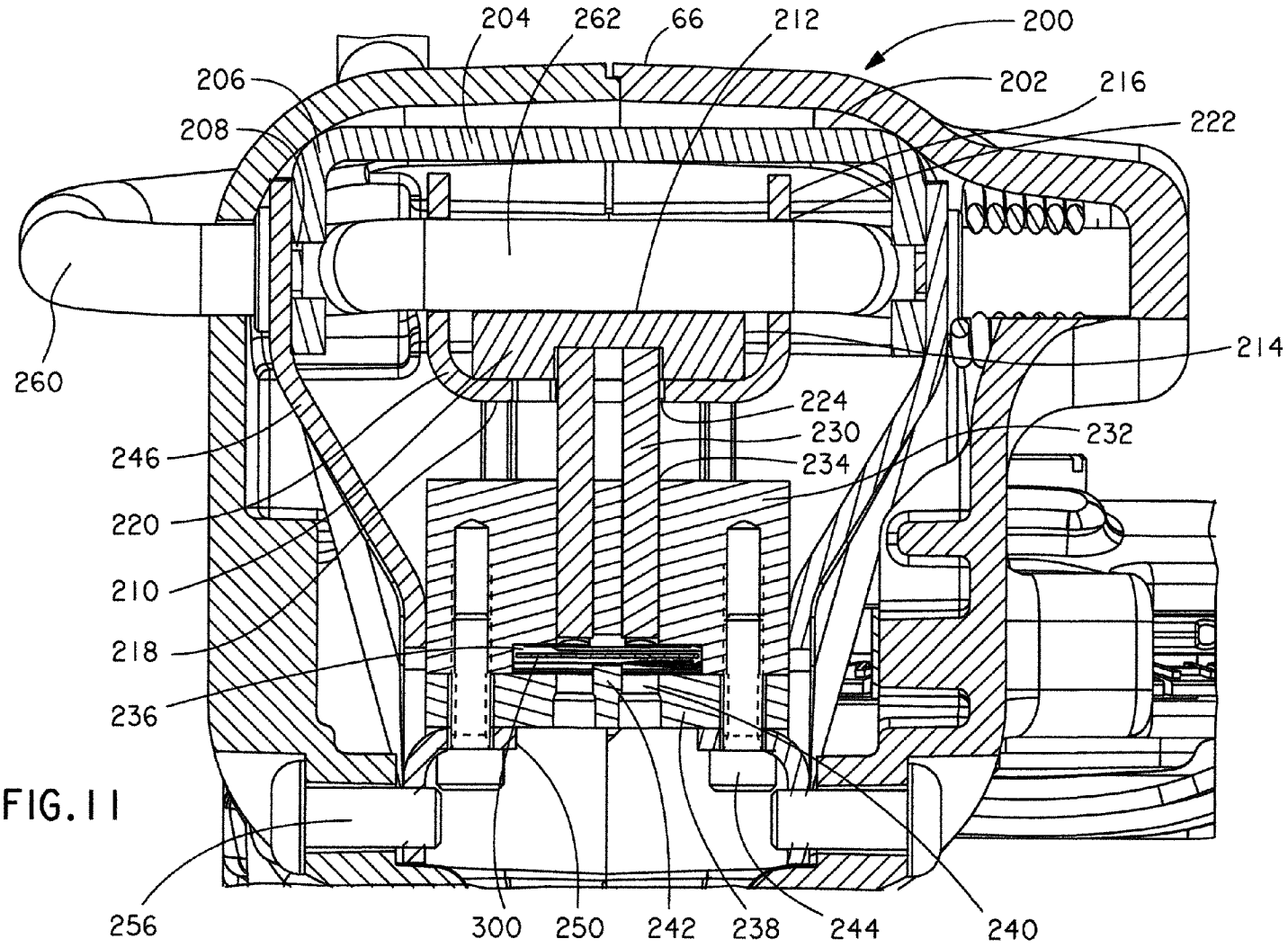
FIG. 11 is a cross-sectional view of the metal embossing hand tool of FIG. 9 taken along line 11-11.
Figure 12:
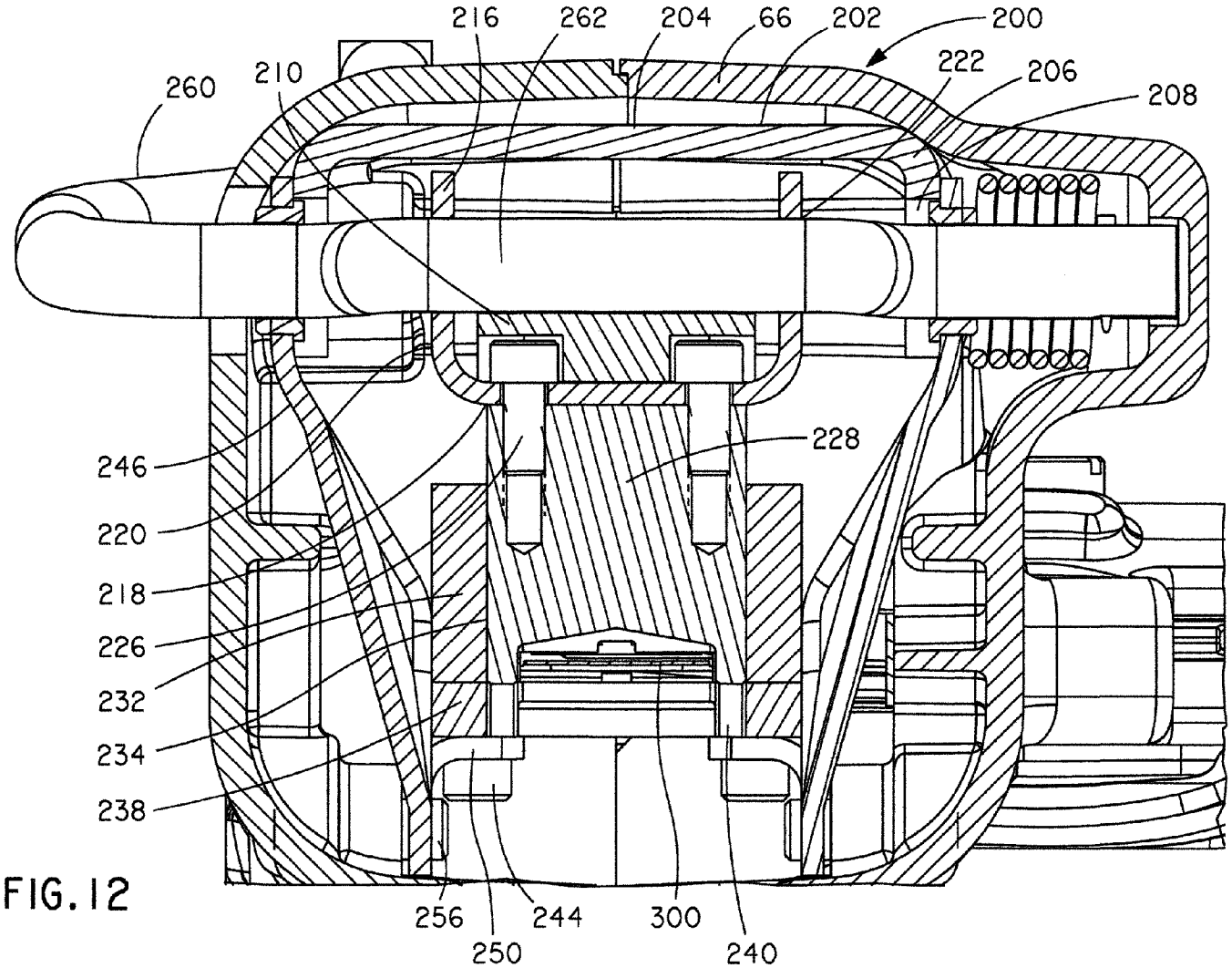
FIG. 12 is a cross-sectional view of the metal embossing hand tool of FIG. 9 taken along line 12-12.

FIGS. 11 and 12 further illustrate the multifunction cutting die 200 of the present invention. The upper die plate 232 is secured to the lower die plate 238 by a plurality of fasteners 244, such as screws. As discussed above, a center opening 236 is formed between the upper die plate 232 and the lower die plate 238 for receiving the tape 300. FIG. 11 illustrates one of the mounting feature punches 230 positioned in the upper die plate 232 above the tape 300. The punch retainer plate 216, lower holder member 210 and the upper holder member 202 are positioned above the mounting feature punches 230 and the cut off punch 228. FIG. 12 illustrates the cut off punch 228 secured to the punch retainer plate 216 by fasteners 226, such as screws.

The punch retainer plate 216 includes a bottom 218 with two sides 220. The bottom 218 includes a plurality of openings 224 for receiving the mounting feature punches 230 and the cut off punch 228 and each side 220 includes an opening 222 for receiving the wire handle 260. The lower holder member 210 is positioned on the punch retainer plate 216. The lower holder member 210 engages the mounting feature punches 230 and the cut off punch 228 before the cutting die 200 is activated.

A handle bracket 246 is positioned on either side of the upper and lower die plates 232, 238, respectively. The handle brackets 246 include a tab 250 with an opening 252 for receiving the fasteners 244 that secure the upper and lower die plates 232, 238, respectively, together. The handle brackets 246 also include an opening 254 for receiving a fastener 256 to secure the handle brackets to the main body 52 of the tool 50. As such, as illustrated in FIG. 11, the handle brackets 246 are secured at the bottom of the lower die plate 238. The handle brackets 246 extend upwardly and outwardly away from the upper and lower die plates 232, 238. As discussed above, the upper portion of the handle brackets 246 includes an opening 248 for receiving the wire handle 260.

The upper holder member 202 includes a top 204 with two downwardly extending sides 206. Each side 206 has a semi-circular opening 208 for receiving the wire handle 260. The upper holder member 202 is positioned between the handle brackets 246 so that the semi-circular openings 208 are adjacent to the openings 248 in the handle brackets 246.

As illustrated in FIGS. 11 and 12, the wire handle 260 includes a bend 262 which creates a crank to actuate the cutting die 200. The wire handle 260 extends through the right handle bracket 246, the right side 206 of the upper holder member 202, the punch retainer plate 216, the left side 206 of the upper holder member 202 and the left handle bracket 246. The wire handle 260 is also positioned on the lower holder member 210. Thus, when the wire handle 260 is activated, the wire handle 260 forces the lower holder member 210, punch retainer plate 216 and attached mounting feature punches 230 and cut off punch 228 downwards.

The multifunction cutting die 200 is designed to return to the initial or home position when the wire handle 260 is pulled back. This eliminates the need for return springs in the cutting die 200.

Figure 13:
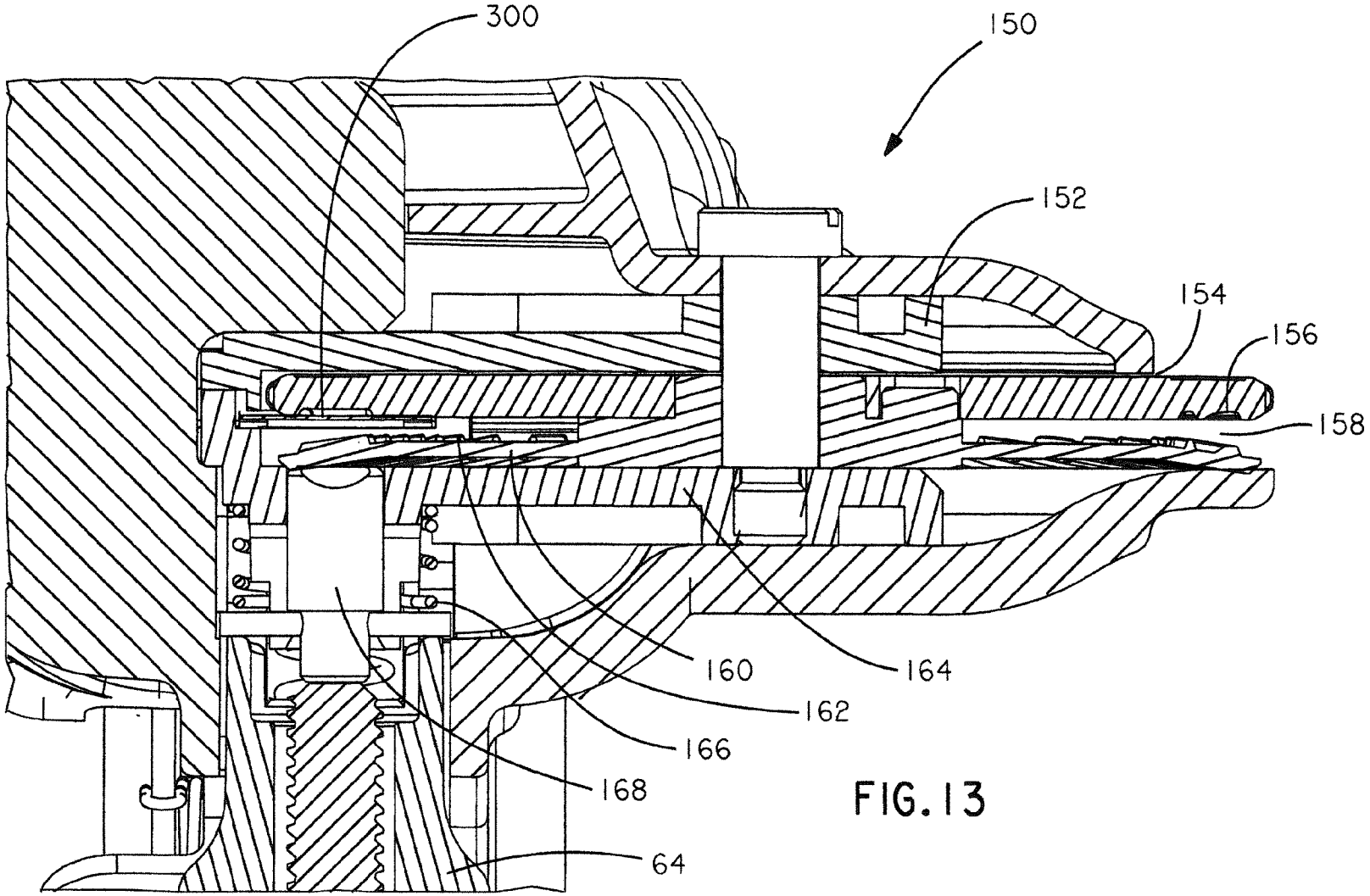
FIG. 13 is a cross-sectional view of the metal embossing hand tool of FIG. 9 taken along line 13-13.

FIG. 13 illustrates the tape 300 positioned between the top and bottom embossing wheels 154, 160. As discussed above, the embossing mechanism 150 includes an embossing pin 168 that is pivotally connected to the hand lever 64. The embossing pin 168 flexes the bottom embossing wheel 160. As result, when the hand lever 64 is actuated, the spring 166 around the embossing pin 168 is compressed thereby forcing the embossing pin 168 to engage the bottom embossing wheel 160. The embossing pin 168 presses the raised character 162 of the bottom wheel 160 into the tape 300 and the recessed character 156 of the top wheel 154 to emboss the character on the tape 300 (see FIGS. 22-25).

Figure 14:
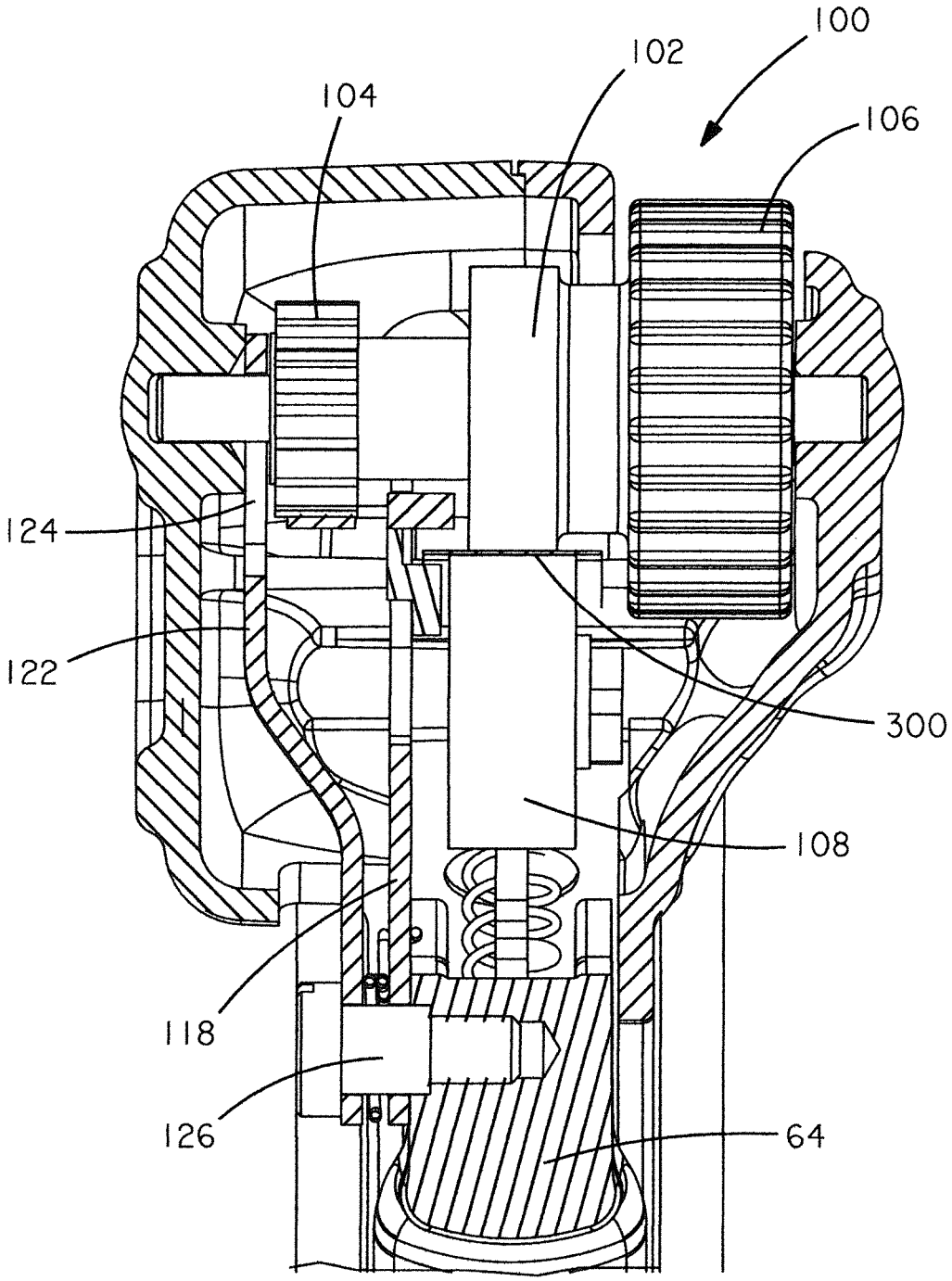
FIG. 14 is a cross-sectional view of the metal embossing hand tool of FIG. 9 taken along line 14-14.
Figure 15:
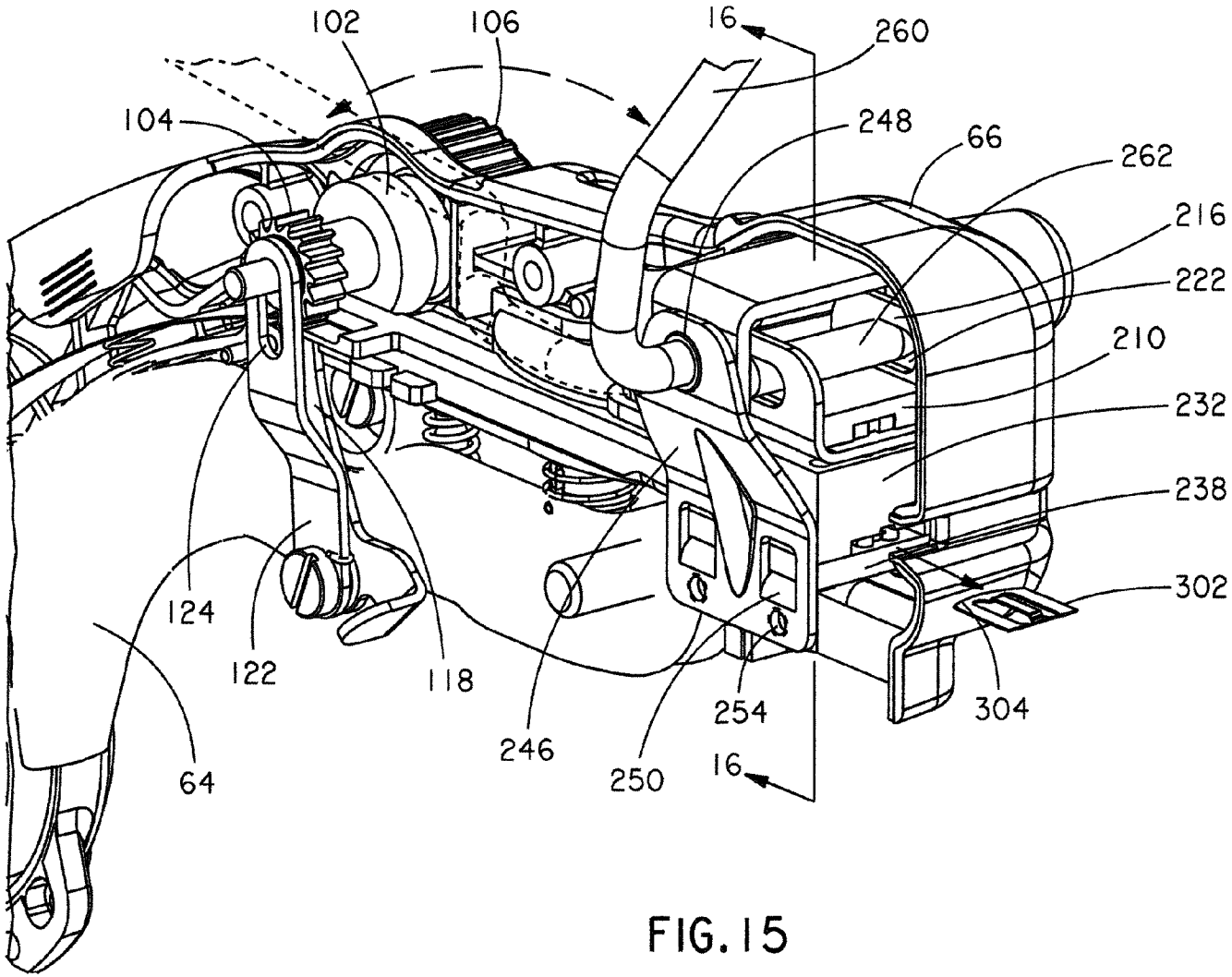
FIG. 15 is a front right side perspective view of the metal embossing hand tool of FIG. 1 with the right body enclosure removed.
Figure 16:
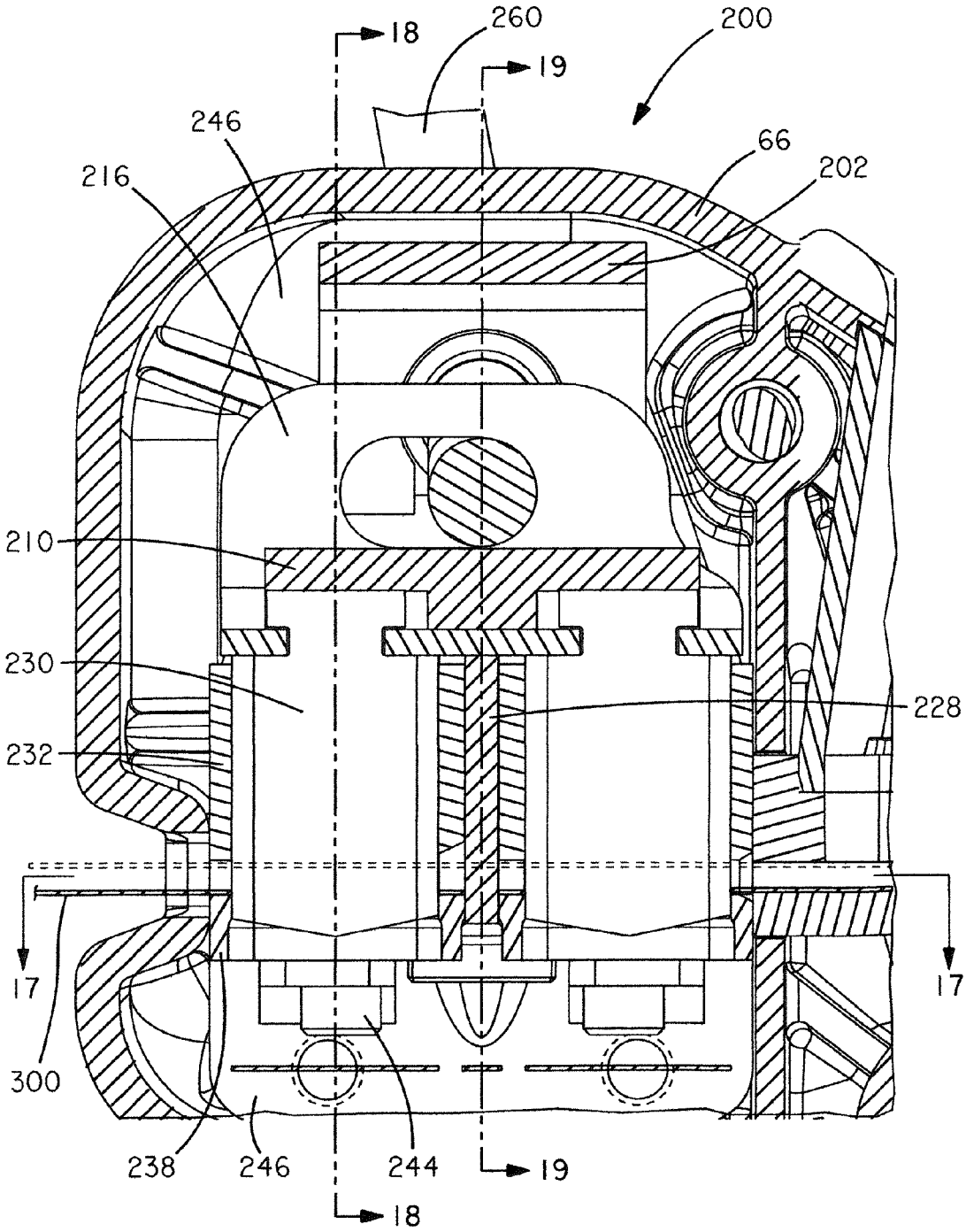
FIG. 16 is a cross-sectional view of the metal embossing hand tool of FIG. 15 taken along line 16-16.

FIG. 14 illustrates the tape 300 positioned between the drive wheel 102 and the idler wheel 108. The drive arm 122 and the indexing arm 118 are secured to the hand lever 64 via a fastener 126. The drive arm 122 includes a slot 124 for enabling the drive arm 122 to move with respect to the ratchet wheel 104. The indexing arm 118 engages the ratchet wheel 104 which in turn actuates the drive wheel 102 and the idler wheel 108 to advance the tape 300 therebetween. Alternatively, as will be discussed with respect to FIGS. 26 and 27, the tape 300 may be advanced by the manual advance wheel 106.

FIGS. 15-20 illustrate the multifunction cutting die 200 of the metal embossing hand tool 50 when the wire handle 260 has been actuated. Once the wire handle 260 has been actuated, the trailing end 304 of one tag 302 or plate is formed enabling the completed tag 302 or plate to exit the cutting die 200 while the leading end 306 of the next tag 302 or plate is formed (see FIG. 17A).

Figure 17:
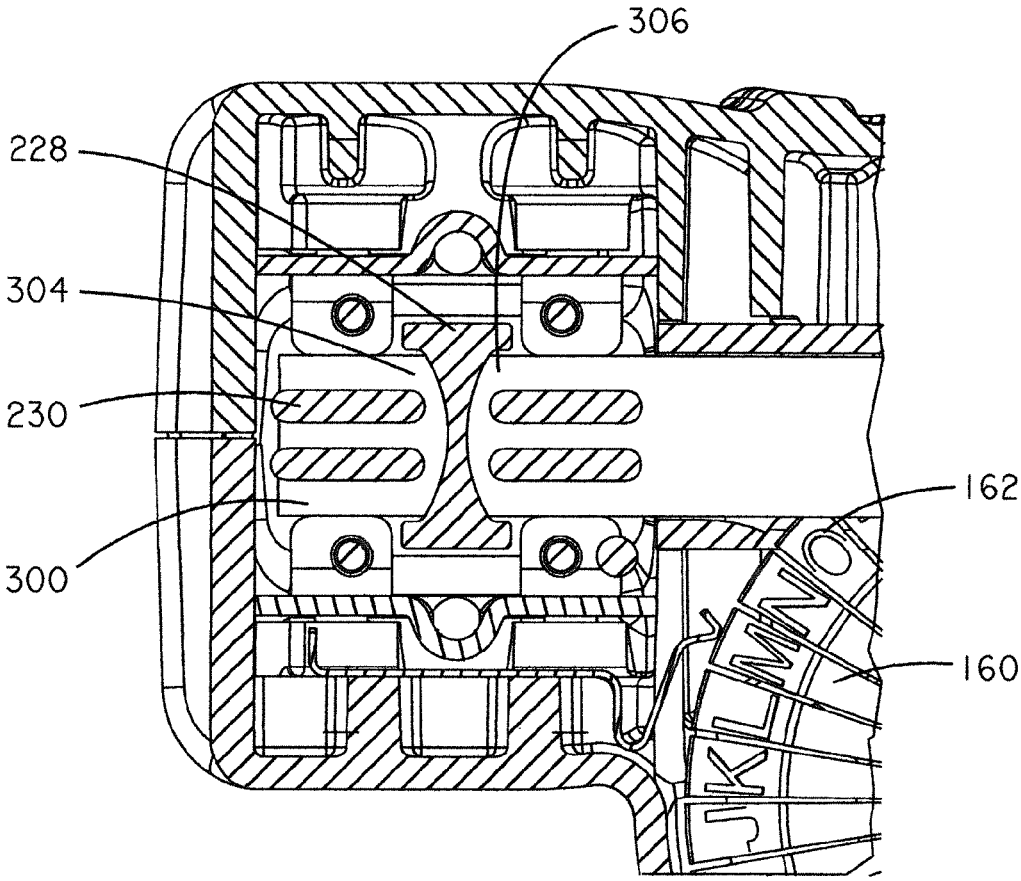
FIG. 17 is a cross-sectional view of the metal embossing hand tool of FIG. 16 taken along line 17-17.
Figure 17A:
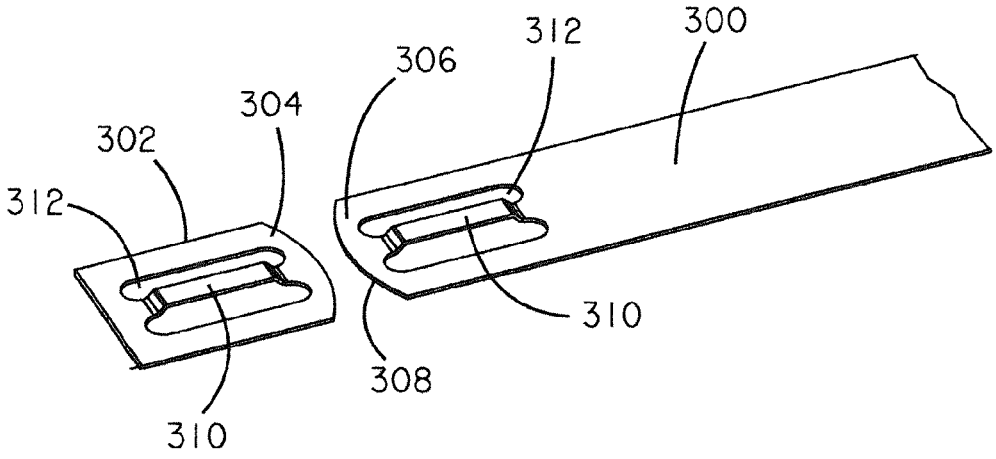
FIG. 17*a* is a perspective view of the mounting feature created by the cutting die of FIG. 17.
Figure 18:
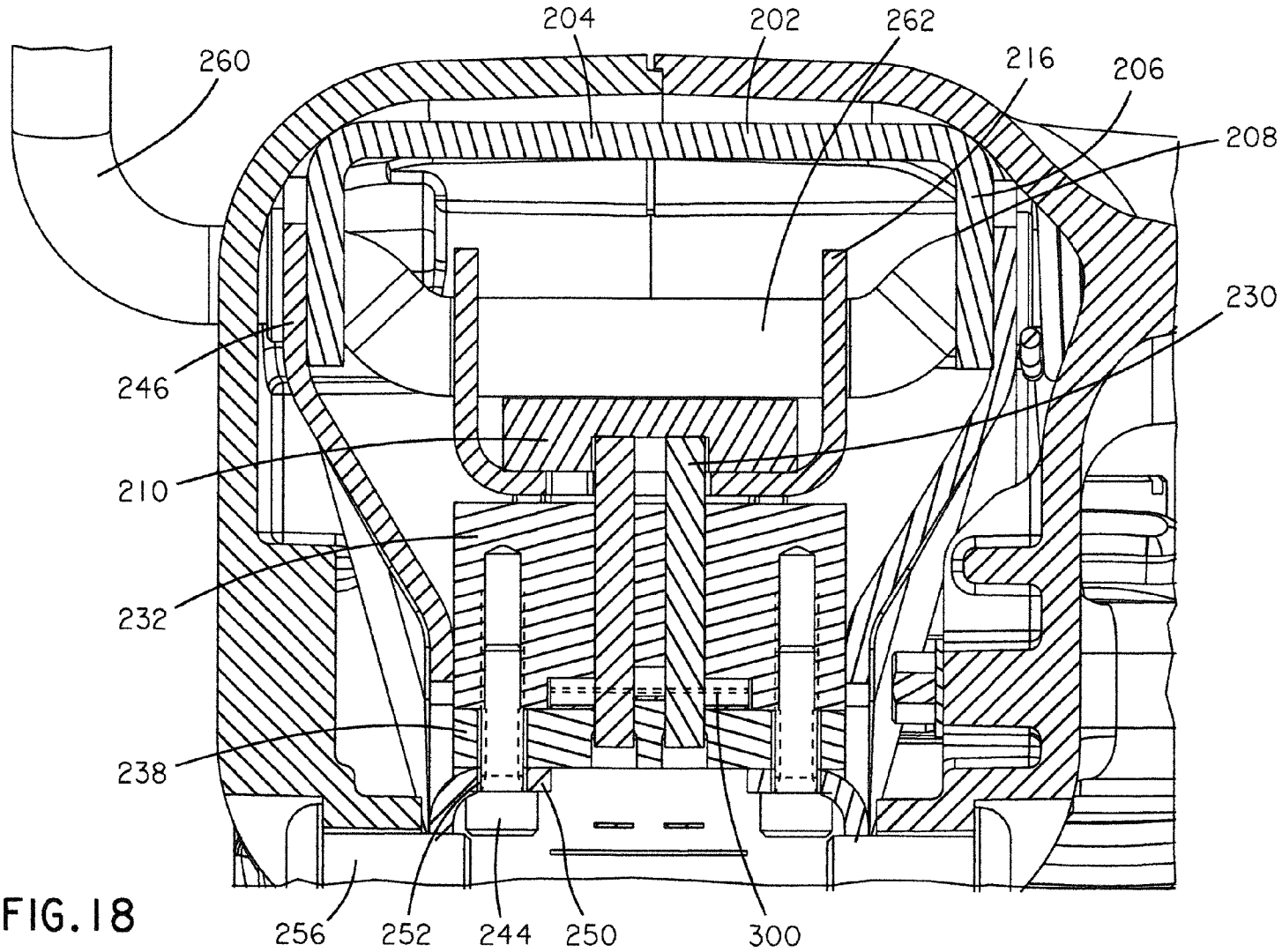
FIG. 18 is a cross-sectional view of the metal embossing hand tool of FIG. 16 taken along line 18-18.
Figure 19:
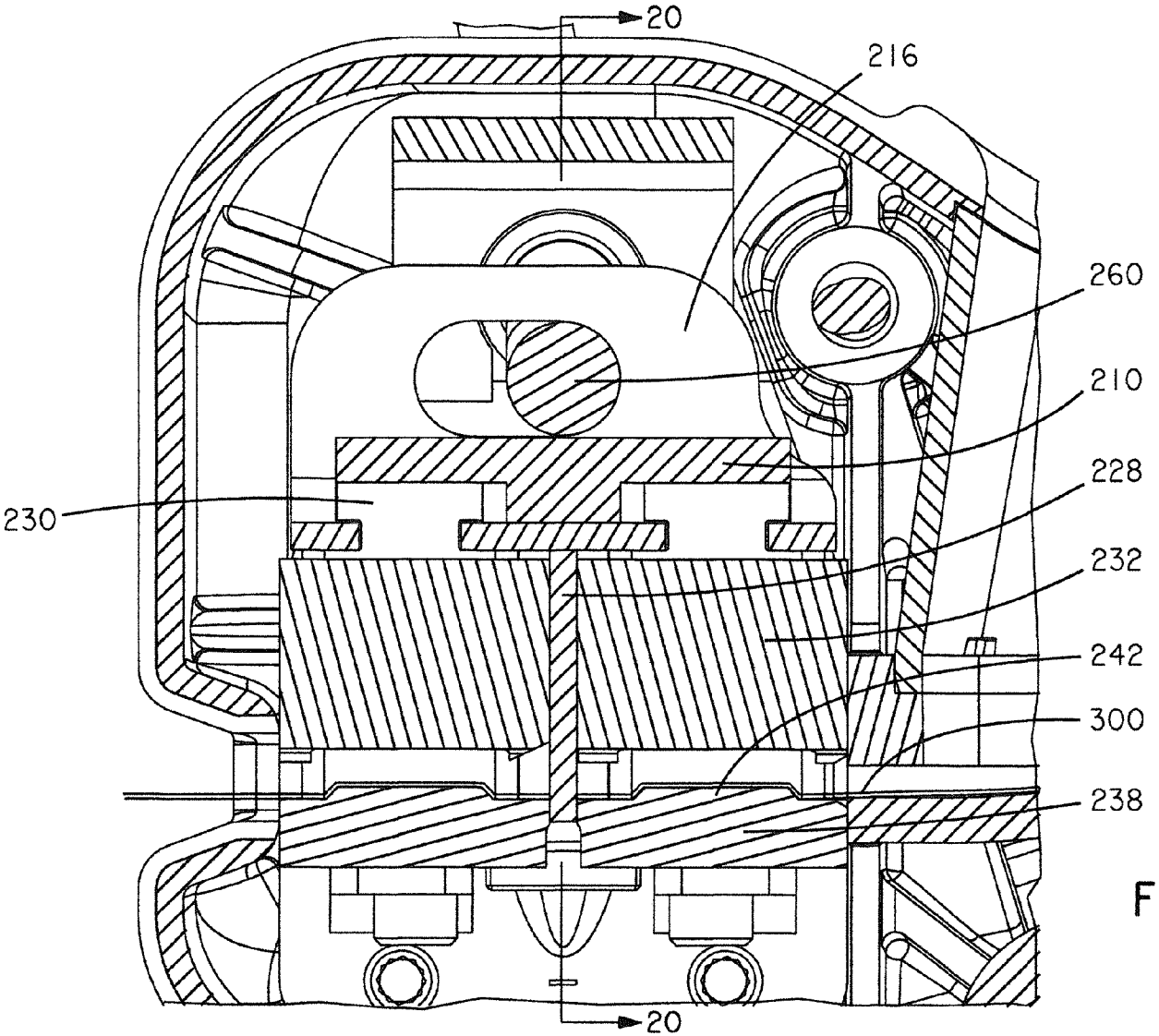
FIG. 19 is a cross-sectional view of the metal embossing hand tool of FIG. 16 taken along line 19-19.
Figure 20:
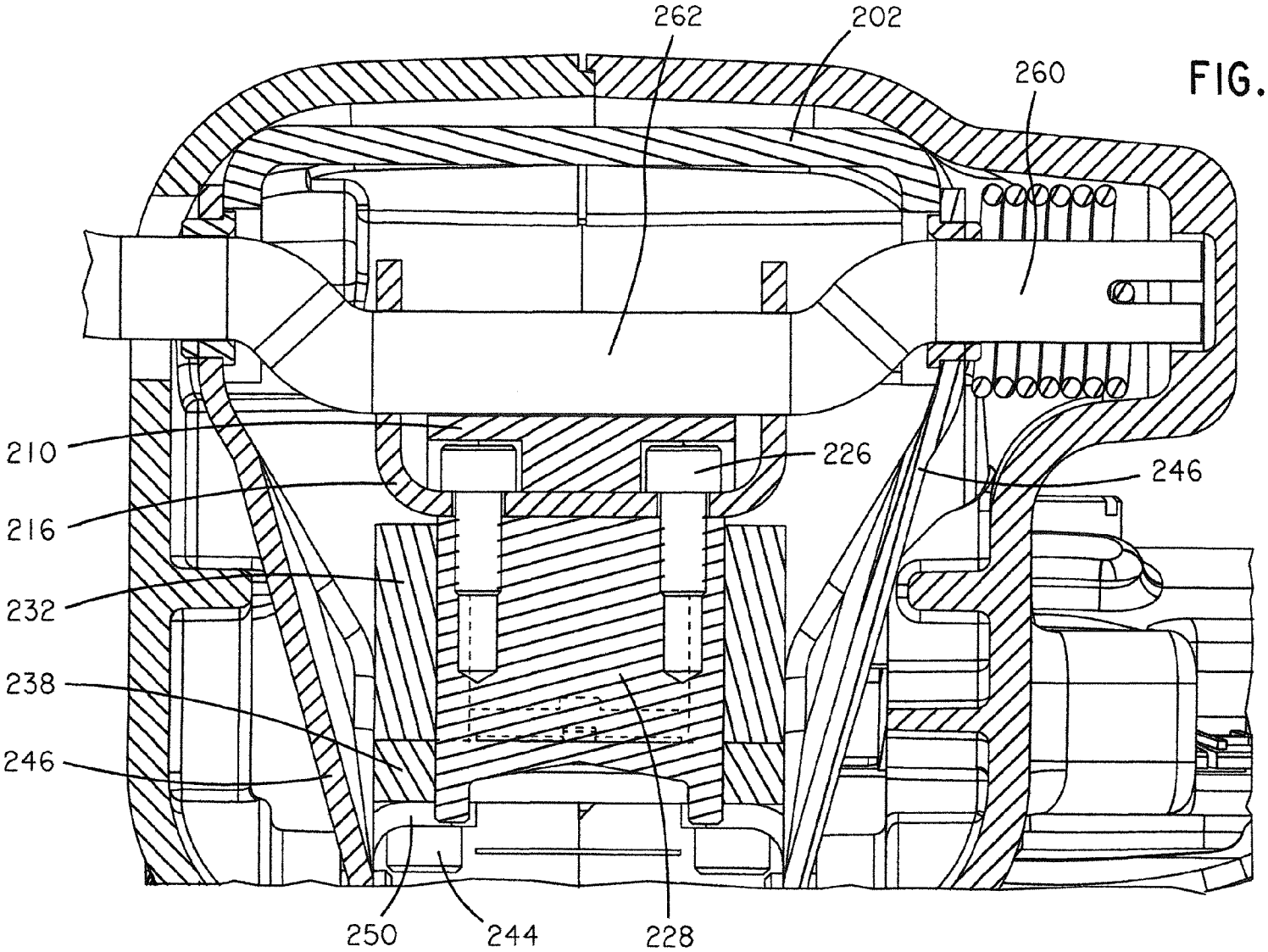
FIG. 20 is a cross-sectional view of the metal embossing tool of FIG. 19 taken along line 20-20.
Figure 21:
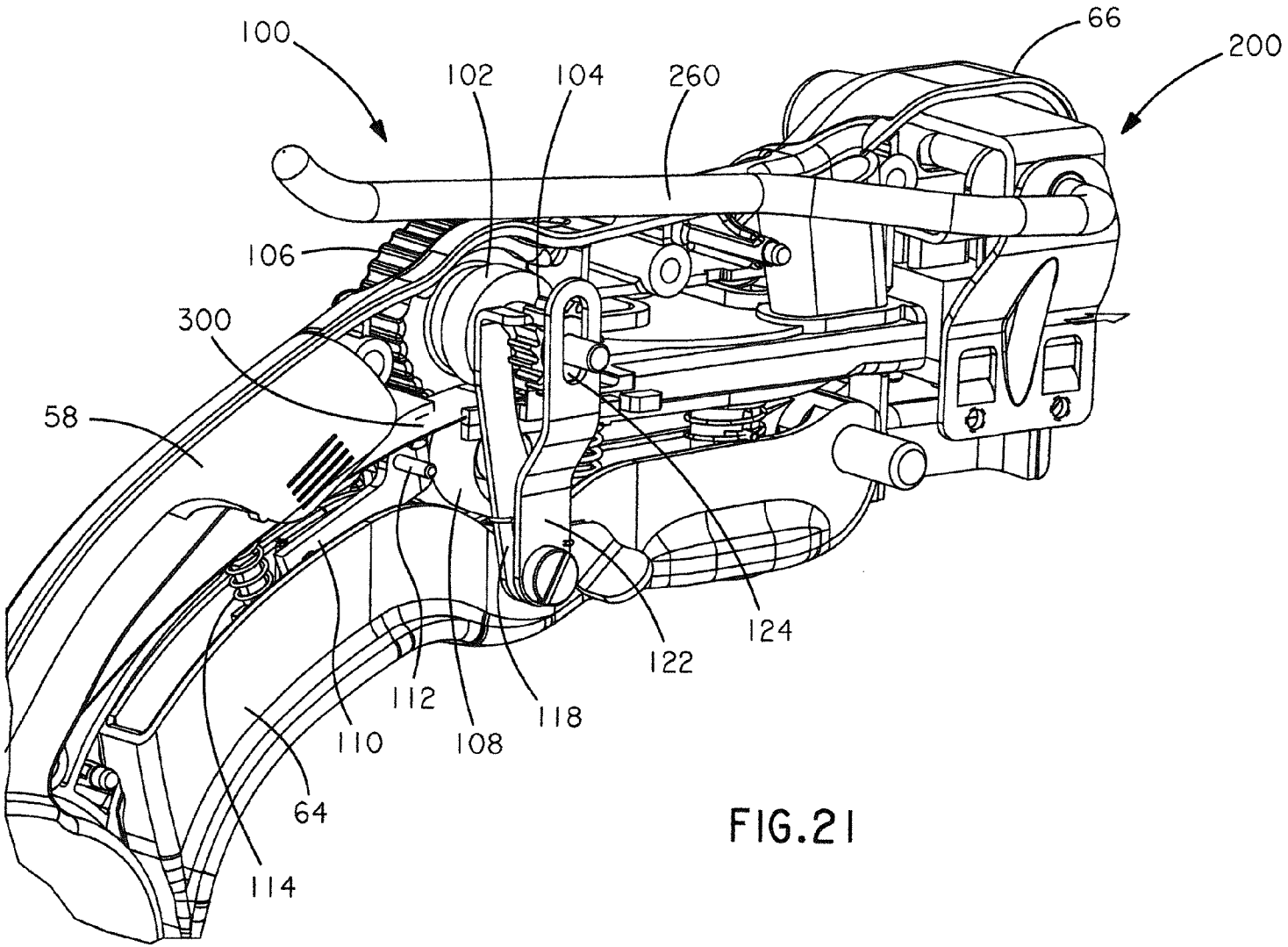
FIG. 21 is a back right side perspective view of the metal embossing hand tool of FIG. 6 with the right body enclosure removed.
Figure 22:
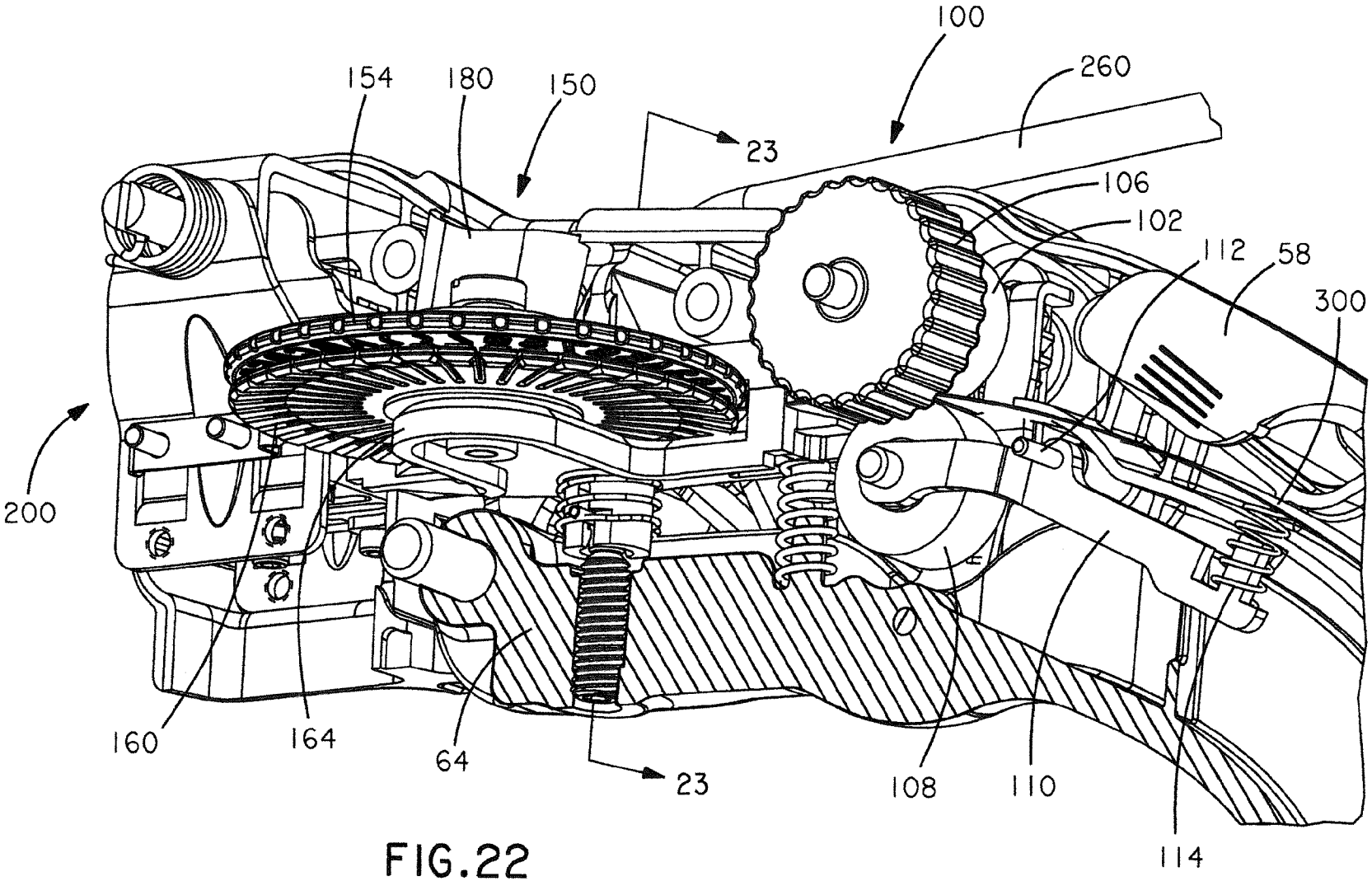
FIG. 22 is a bottom left side partial perspective view of the metal embossing hand tool of FIG. 21 with the left body enclosure removed.
Figure 23:
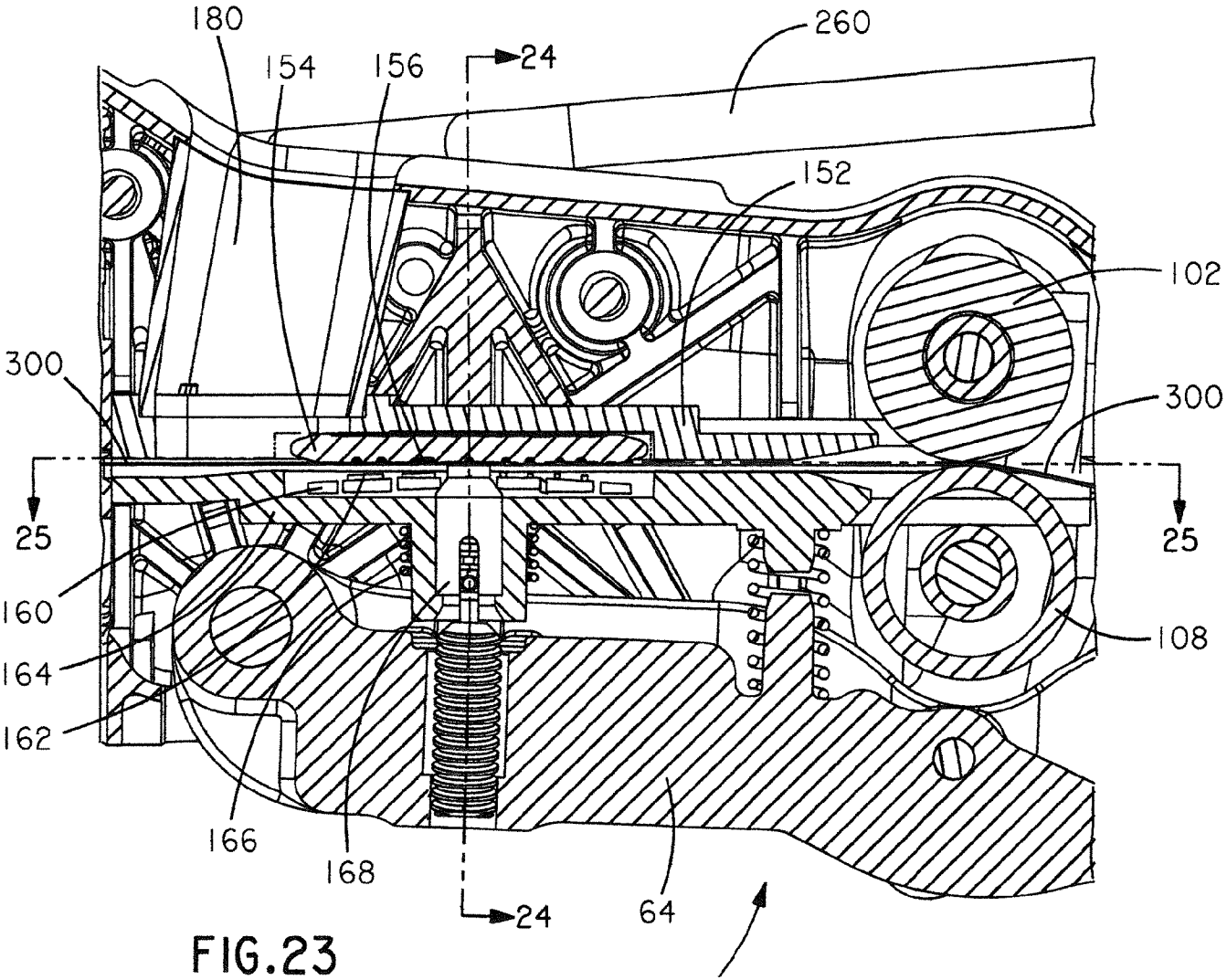
FIG. 23 is a cross-sectional view of the metal embossing hand tool of FIG. 22 taken along line 23-23.
Figure 24:
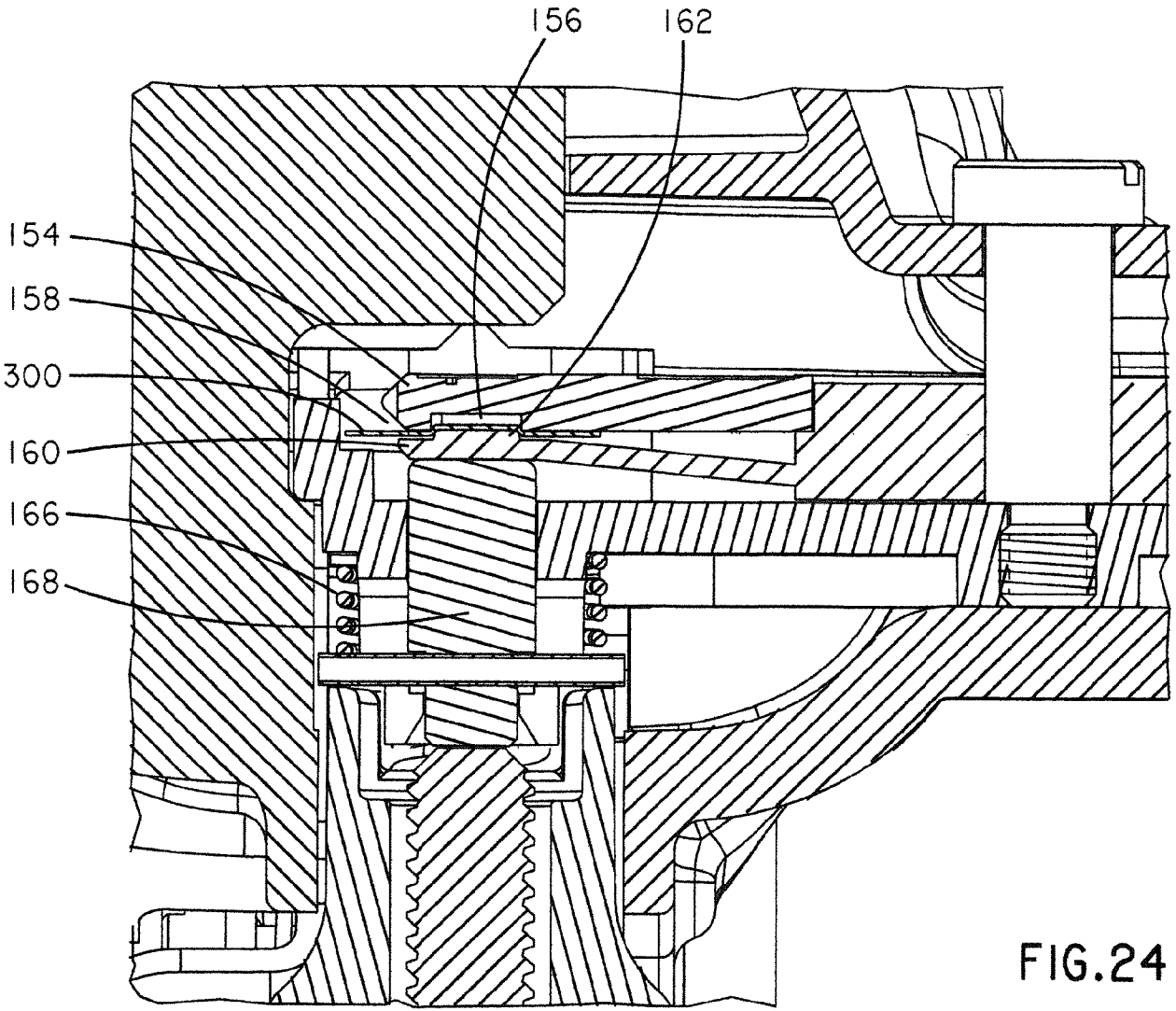
FIG. 24 is a cross-sectional view of the metal embossing hand tool of FIG. 23 taken along line 24-24.

The actuated wire handle 260 forces the cut off punch 228 and the mounting feature punches 230 downward through the tape 300 into the lower die plate 238. As illustrated in FIG. 17, the mounting feature punches 230 form the mounting holes or slots 312 and the cut off punch 228 cuts the tape 300 to form semi-circular ends 308. This eliminates sharp edges on the finished tag 302 or plate. Additionally, as illustrated in FIG. 19, the lower die plate 238 forms the raised area 310 adjacent the mounting hole or slot 312 to maintain a cable tie received in the hole 312 or slot.

Once the leading end 306 of the next tag 302 or plate has been formed, the tape 300 may be embossed. FIGS. 21-25 further illustrate the drive mechanism 100 and the embossing mechanism 150 of the metal embossing hand tool 50. The embossing wheels 154, 160 are manually turned to select the desired character to be embossed. As discussed above, the metal tape 300 passes between the bottom wheel 160 and the top wheel 154. When the hand lever 64 is actuated, the embossing pin 168 initiates the flex of an individual raised character 162 on the bottom wheel 160. The raised character 162 pushes the metal tape 300 into the recessed character 156 on the top wheel 154 to emboss the character on the tape 300. The embossed characters on the tape 300 may be viewed through the embossing preview window 180 in the main body 52 of the embossing hand tool 50.

Figure 25:
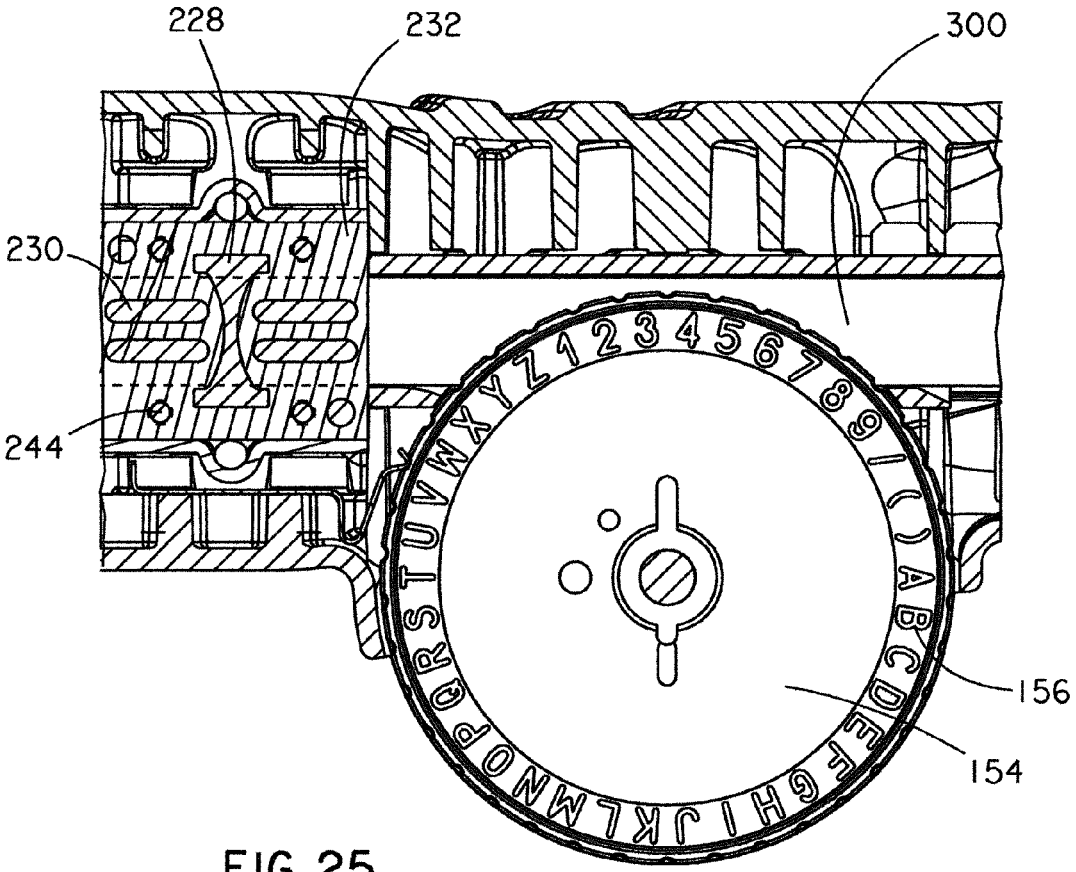
FIG. 25 is a cross-sectional view of the metal embossing hand tool of FIG. 23 taken along line 25-25.
Figure 25A:
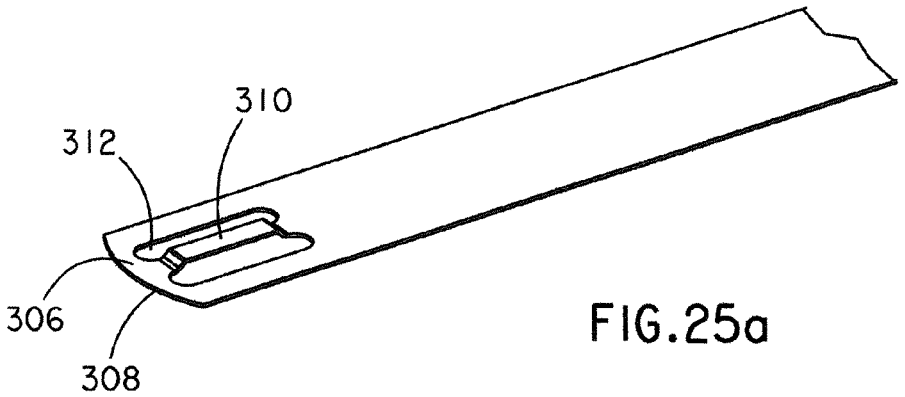
FIG. 25*a* is a perspective view of the tape embossed and cut by the metal embossing hand tool of FIG. 1.

FIG. 25*a* illustrates the embossed tag 302 or plate with the complete leading end 306. To complete the tag 302 or plate, the wire handle 260 would be actuated to lower the mounting feature punches 230 and cut off punch 228 to form the trailing end 304 of the tag 302 or plate. As a result, the multifunction cutting die 200 of the metal embossing hand tool 50 of the present invention creates a complete tag 302 or plate without reinserting the ends of the tag or plate into the tool to form a mounting feature.

Figure 26:
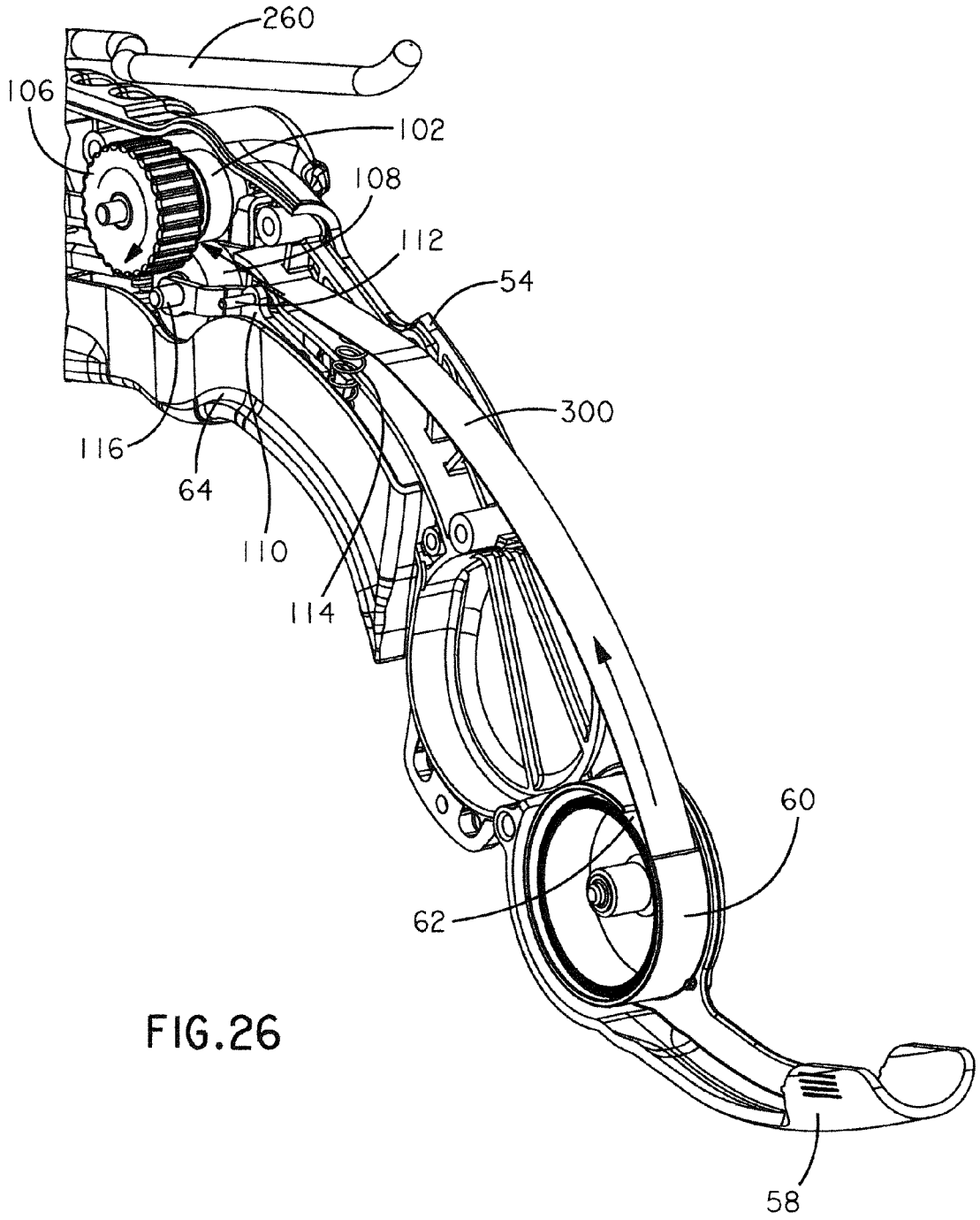
FIG. 26 is a back left side perspective view of the metal embossing hand tool of FIG. 1 with the left body enclosure removed and the flip up cover open for installation of the metal tape.
Figure 27:
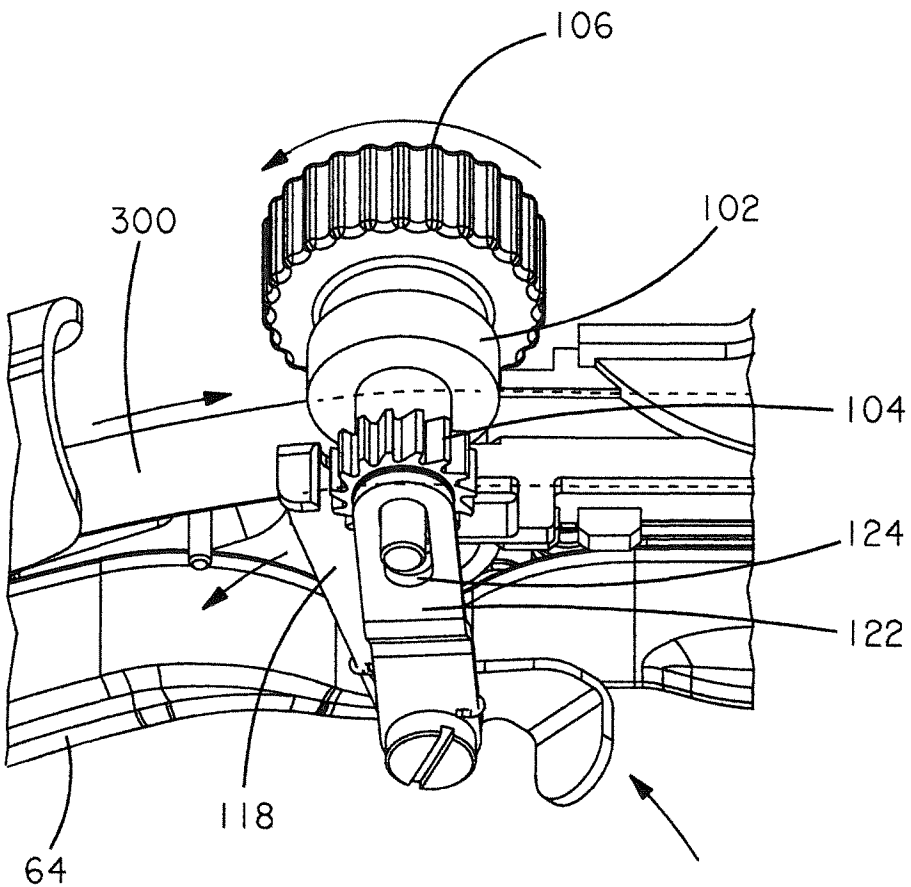
FIG. 27 is a top right perspective view of the drive mechanism of the metal embossing tool of FIG. 26.

FIGS. 26-27 illustrate a metal tape 300 being manually fed in the metal embossing hand tool 50. To manually reverse the metal tape 300, the indexing arm 118 is disengaged from the ratchet wheel 104 by pushing indexing arm 118 upwards. Once the hand lever 64 is actuated, the manual advance wheel 106 may be rotated by the operator. As the manual advance wheel 106 rotates, the drive wheel 102 and the idler wheel 108 rotate thereby advancing the metal tape 300. As the tool is reversed the tape holder 60 rotates in a clockwise direction and the tape is fed back into the tool. It can be fed back approximately 350 degrees or approximately 5 inches.

Furthermore, while the particular preferred embodiments of the present invention have been shown and described, it will be obvious to those skilled in the art that changes and modifications may be made without departing from the teaching of the invention. The matter set forth in the foregoing description and accompanying drawings is offered by way of illustration only and not as limitation. The actual scope of the invention is intended to be defined in the following claims when viewed in their proper perspective based on the prior art.

The invention claimed is:

1. An embossing tool comprising:

a drive mechanism for advancing a tape;

an embossing mechanism; and a cutting mechanism for cutting the tape and for forming a mounting feature in the tape;

wherein the cutting mechanism includes a pair of dies with openings therethrough and at least one punch moveable within the openings for engaging the tape, wherein the pair of dies includes an upper die plate and a lower die plate with an opening between the upper die plate and the lower die plate for receiving the tape, and wherein the lower die plate includes a raised section for forming a raised section in the tape.

2. The embossing tool of claim 1, wherein the at least one punch is positioned within the upper die plate above the tape.

3. The embossing tool of claim 1, wherein the at least one punch further comprising a cut off punch for cutting the tape and a mounting feature punch for forming a mounting feature in the tape, whereby the cut off punch and the mounting feature punch simultaneously engage the tape.

4. The embossing tool of claim 3, wherein the cut off punch forms semi-circular ends.

5. The embossing tool of claim 3, wherein the mounting feature punch forms a mounting feature on a trailing end of a first formed tag and a mounting feature on a leading end of a second formed tag, whereby the mounting feature includes two holes with the raised section therebetween for receiving a cable tie.

6. The embossing tool of claim 1, wherein the cutting mechanism further comprising a wire handle for activating the cutting mechanism, the wire handle is secured to handle brackets positioned on opposite sides of the pair of dies.

7. The embossing tool of claim 6, wherein the cutting mechanism further comprising a holder member and a punch retainer plate positioned between the handle brackets above the pair of dies, wherein the punch retainer plate receives the wire handle.

8. The embossing tool of claim 7, wherein the punch retainer plate includes openings therethrough for receiving the at least one punch and wherein the holder member is positioned on the punch retainer plate to engage the at least one punch before the cutting mechanism is activated.

9. The embossing tool of claim 8, wherein the wire handle forces the holder member, the punch retainer plate and the at least one punch downwards, wherein the at least one punch is pushed through the tape and into the lower die plate to cut the tape.

10. The embossing tool of claim 1, wherein the drive mechanism includes a drive wheel and an idler wheel for receiving the tape therebetween.

11. The embossing tool of claim 10, wherein the drive mechanism includes a pivot arm, one end of the pivot arm is mounted to the idler wheel and the opposite end of the pivot arm engages a spring, whereby the pivot arm enables the idler wheel to maintain contact with the drive wheel.

12. The embossing tool of claim 1, wherein the embossing mechanism includes a bottom wheel with raised characters and a top wheel with recessed characters with an opening therebetween for receiving the tape, wherein an embossing pin flexes the bottom wheel to press the raised characters into the recessed characters in the top wheel and the tape positioned therebetween.

* * * * *